US005999872A

United States Patent [19]

Kinugawa et al.

[11] Patent Number: 5,999,872

[45] Date of Patent: Dec. 7, 1999

[54] CONTROL APPARATUS FOR HYDRAULIC EXCAVATOR

[75] Inventors: Hideki Kinugawa; Masayuki Komiyama, both of Hiroshima; Naoki Tamura; Atsushi Onishi, both of Kobe; Takahiro Kobayashi; Kiyotsuna Kuchiki, both of Akashi, all of Japan

[73] Assignee: Kabushiki Kaisha Kobe Seiko Sho, Kobe, Japan

[21] Appl. No.: 08/794,903

[22] Filed: Feb. 4, 1997

[30] Foreign Application Priority Data

| | | | |
|---|---|---|---|
| Feb. 15, 1996 | [JP] | Japan | 8-028266 |
| Jul. 5, 1996 | [JP] | Japan | 8-176664 |
| Aug. 21, 1996 | [JP] | Japan | 8-219896 |

[51] Int. Cl.[6] ..... E02F 3/00; G60F 15/00

[52] U.S. Cl. ..... 701/50; 172/4.5; 172/4; 172/2

[58] Field of Search ..... 701/50; 60/452; 417/212, 213, 216; 172/2, 3, 4, 4.5, 260.5, 263, 265

[56] References Cited

U.S. PATENT DOCUMENTS

| | | | |
|---|---|---|---|
| 5,065,326 | 11/1991 | Sahm | 701/50 |
| 5,442,868 | 8/1995 | Ahn | 701/50 |
| 5,493,798 | 2/1996 | Rocke et al. | 701/50 |
| 5,527,156 | 6/1996 | Song | 417/2 |
| 5,768,810 | 6/1998 | Ahn | 701/50 |

*Primary Examiner*—William A. Cuchlinski, Jr.
*Assistant Examiner*—Yonel Beaulieu
*Attorney, Agent, or Firm*—Oblon, Spivak, McClelland, Maier & Neaustadt, P.C.

[57] ABSTRACT

A control apparatus for a hydraulic excavator is capable of carrying out precise operations according to various kinds of classifications of works without requiring switching operations by an operator and management according to work records. The apparatus includes a classification of work discriminating section for recognizing a classification of work being carried out by the hydraulic excavator on the basis of data detected by sensors for detecting an operating amount of a lever for a boom and the like; sections for setting an operating mode of hydraulic pumps absorbing horse power and the like, according to the classification of work recognized; a hydraulic pump control section for controlling the hydraulic pumps according to the set operating mode; and an auto acceleration control section for making effective or invalid the auto acceleration control for controlling speed of an engine to a low speed when work stops. The apparatus further includes a device for readably storing the recognized classification of work in terms of a time series.

31 Claims, 17 Drawing Sheets

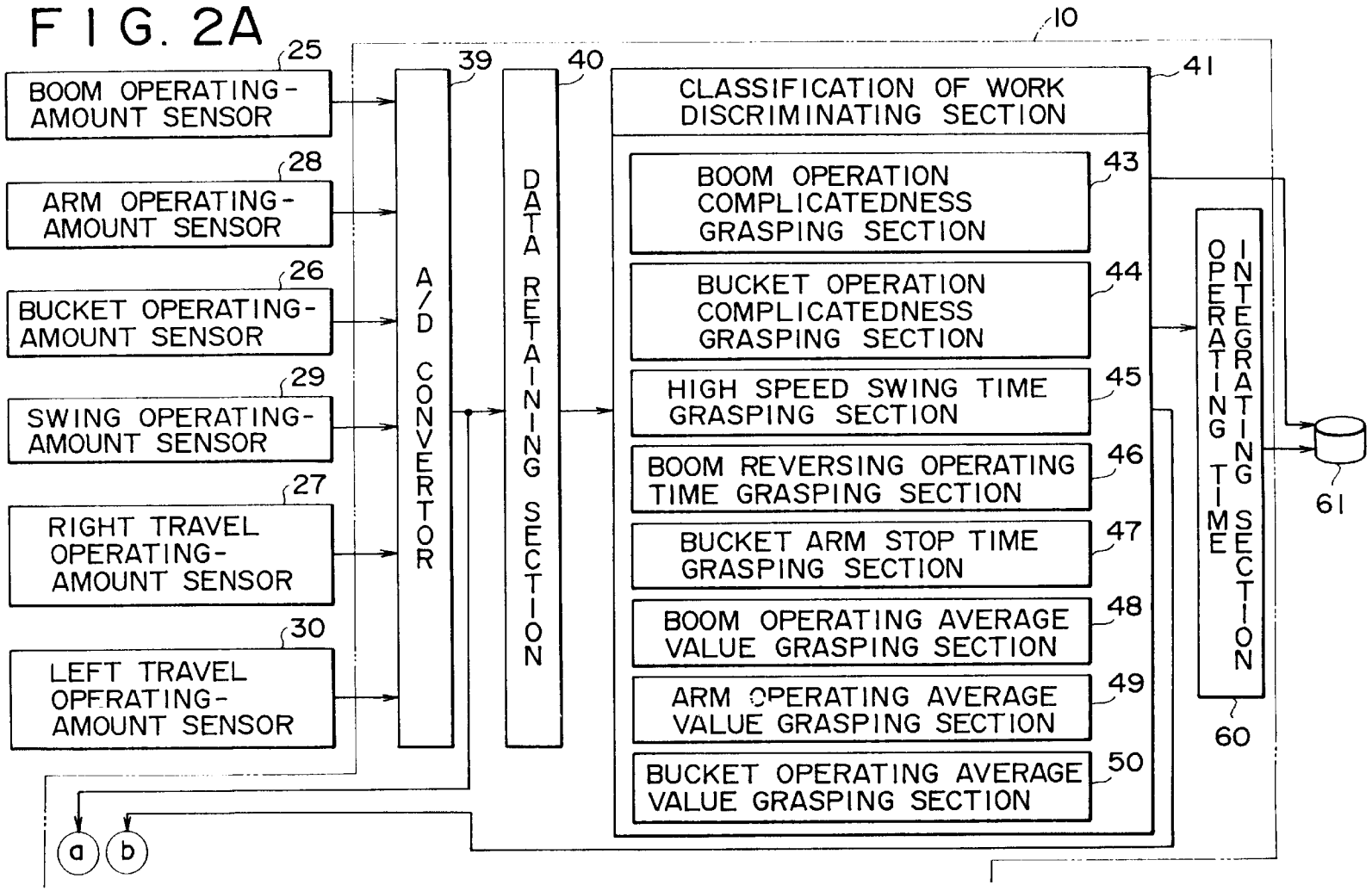
FIG. 2A
BOOM OPERATING-AMOUNT SENSOR
25
ARM OPERATING-AMOUNT SENSOR
28
BUCKET OPERATING-AMOUNT SENSOR
26
SWING OPERATING-AMOUNT SENSOR
29
RIGHT TRAVEL OPERATING-AMOUNT SENSOR
27
LEFT TRAVEL OPERATING-AMOUNT SENSOR
30
A/D CONVERTOR
39
DATA REFRAINING SECTION
40
CLASSIFICATION OF WORK DISCRIMINATING SECTION
41
BOOM OPERATION COMPLICATEDNESS GRASPING SECTION
43
BUCKET OPERATION COMPLICATEDNESS GRASPING SECTION
44
HIGH SPEED SWING TIME GRASPING SECTION
45
BOOM REVERSING OPERATING TIME GRASPING SECTION
46
BUCKET ARM STOP TIME GRASPING SECTION
47
BOOM OPERATING AVERAGE VALUE GRASPING SECTION
48
ARM OPERATING AVERAGE VALUE GRASPING SECTION
49
BUCKET OPERATING AVERAGE VALUE GRASPING SECTION
50
INTEGRATING SECTION
OPERATING TIME
60
61
10
a
b 42
OPERATING MODE CONTROL SECTION
51
ABSORBING HORSE POWER SETTING SECTION
52
MAXIMUM DISCHARGE SETTING SECTION
53
DISCHARGE RATE OF CHANGE SETTING SECTION
54
RESPONSE TIME CONSTANT SETTING SECTION
55
HYDRAULIC PUMP CONTROL SECTION
56
AUTO ACCELERATION CONTROL
23
SECOND SOLENOID VALVE
24
FIRST SOLENOID VALVE
1
ENGINE
a
b

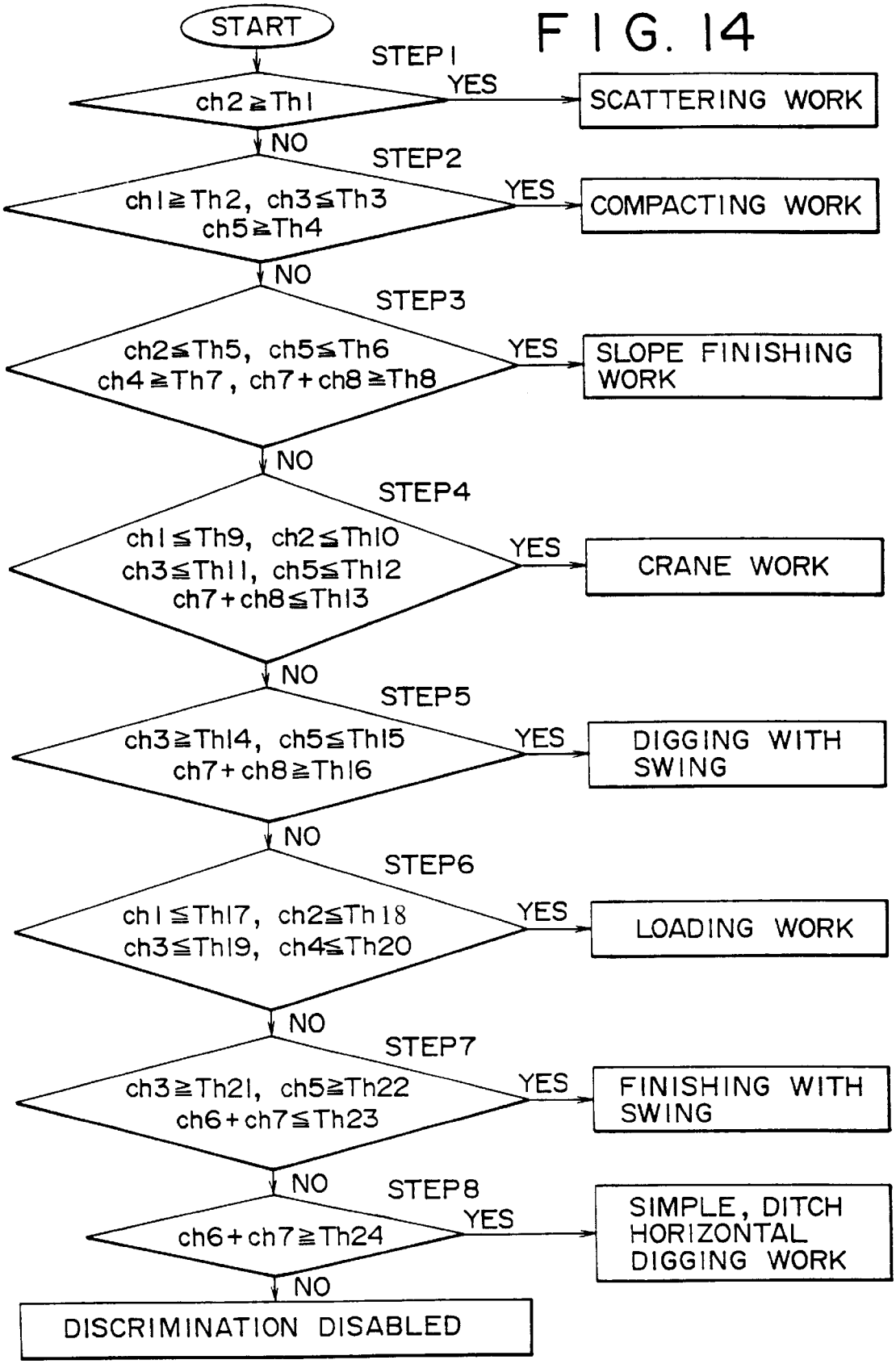
FIG. 14
START
STEP1
ch2≧Th1
YES
SCATTERING WORK
NO
STEP2
ch1≧Th2, ch3≦Th3
ch5≧Th4
YES
COMPACTING WORK
NO
STEP3
ch2≦Th5, ch5≦Th6
ch4≧Th7, ch7+ch8≧Th8
YES
SLOPE FINISHING WORK
NO
STEP4
ch1≦Th9, ch2≦Th10
ch3≦Th11, ch5≦Th12
ch7+ch8≦Th13
YES
CRANE WORK
NO
STEP5
ch3≧Th14, ch5≦Th15
ch7+ch8≧Th16
YES
DIGGING WITH SWING
NO
STEP6
ch1≦Th17, ch2≦Th18
ch3≦Th19, ch4≦Th20
YES
LOADING WORK
NO
STEP7
ch3≧Th21, ch5≧Th22
ch6+ch7≦Th23
YES
FINISHING WITH SWING
NO
STEP8
ch6+ch7≧Th24
YES
SIMPLE, DITCH HORIZONTAL DIGGING WORK
NO
DISCRIMINATION DISABLED

FIG. 19

| TIME DATA (PASSAGE TIME [sec.]) | RESULT OF DISCRIMINATION (CONTENT OF WORK) |
|---|---|
| ⋮ | ⋮ |
| 157698 | 1 SIMPLE DIGGING WORK |
| 157713 | 1 SIMPLE DIGGING WORK |
| 157728 | 1 SIMPLE DIGGING WORK |
| 157758 | 2 SLOPE FINISHING WORK |
| ⋮ | ⋮ |
| 243728 | 0 NON-OPERATING STATE |
| 243743 | 0 NON-OPERATING STATE |
| 243758 | 0 NON-OPERATING STATE |

FIG. 20

| CONTENT OF WORK | INTEGRATED TIME [sec.] |
|---|---|
| 0 (NON-OPERATING STATE) | 76545 |
| 1 (SIMPLE DIGGING WORK) | 34215 |
| 2 (SLOPE FINISHING WORK) | 12345 |
| 3 (DITCH DIGGING WORK) | 26325 |
| 4 (HORIZONTAL DIGGING WORK) | 9750 |
| 5 (FINISHING WITH SWING) | 15000 |
| 6 (COMPACTING WORK) | 21450 |
| 7 (SCATTERING WORK) | 7515 |
| 8 (DIGGING WITH SWING) | 67815 |
| 9 (CRANE WORK) | 19800 |
| 10 (LOADING WORK) | 11190 |
| 11 (TRAVEL OPERATING STATE) | 35310 |
| 255 (DISCRIMINATION DISABLED) | 3690 |

CONTROL APPARATUS FOR HYDRAULIC EXCAVATOR

BACKGROUND OF THE INVENTION

1. Field of the Invention

The present invention relates to a control apparatus for a hydraulic excavator.

2. Description of the Related Art

The hydraulic excavator is provided, as working equipment for work, with an engine and a hydraulic pump driven by the engine, and further provided with hydraulic actuators (hydraulic cylinders) for driving a boom, an arm and a bucket of the hydraulic excavator, hydraulic actuators (hydraulic motors) for swing and travel, and the like. In work, operating levers corresponding to the hydraulic actuators are operated so that working fluid is supplied from a hydraulic pump to the hydraulic actuators whereby the hydraulic actuators are actuated to perform various works.

Works to be done by the hydraulic excavator include various classications of works such as a scattering work, a compacting work, a slope finishing work, a crane work, a digging work, a loading work, a finishing with swing, etc., the digging work including such classifications of works as a digging with swing, a simple digging work, a ditch digging work, a horizontal digging work, etc. In these works, since the motion and the load state of the hydraulic excavator as required are often different, it is preferred that working equipment such as an engine and a hydraulic pump be operated in the precise operating mode corresponding to these classifications of works.

For example, the digging work is generally high in load as compared with other works. It is therefore preferred that the engine and the hydraulic pump be controlled so that a sufficient driving force of the engine may be transmitted to the hydraulic actuators through the hydraulic pump. Conversely, the crane work and the loading work are low in load, and a large driving force of the engine is not necessary. It is therefore preferred that the engine and the hydraulic pump be controlled so as to reduce a fuel consumption of the engine as small as possible.

On the other hand, in a conventional hydraulic excavator so far known, for example, an engine speed can be regulated by a work of an operating mode switch by an operator to regulate an absorbing rate (a so-called absorbing horse power of a hydraulic pump) of a driving force (an output) of the engine into a plurality of classifications of works by a hydraulic pump whereby the work of the hydraulic excavator adapted for the kind of work can be performed.

As an alternative proposal so far known, when work stops at which all operating levers are in a neutral position, if an operator operated a predetermined switch in advance, an engine speed is automatically controlled to a predetermined low engine speed to thereby reduce a fuel consumption of the engine.

However, in the conventional hydraulic excavator as described above, for performing the work of the hydraulic excavator adapted to the kind of work as intended by an operator, it is necessary for the operator himself to discriminate its kind of work from other classifications of works and perform a predetermined switch work. For this reason, the operator often forgets the switch work so that the switch work is not performed. In such a case, there poses an inconvenience that the work of the hydraulic excavator adapted to the kind of work cannot be performed, and capability of the hydraulic excavator cannot be drawn sufficiently. Further, even if in a certain work, an operator performs the switch work, he often forgets, when the other kind of work is performed, to release the switch work. In such a case, there poses an inconvenience that an operator cannot perform the work of the hydraulic excavator as desired.

Furthermore, another hydraulic excavator of this kind has been known in which a so-called hour-meter for counting and recording the operating time of the engine for the hydraulic excavator is mounted for purposes of a personnel management of operators (grasping of labor time, decision of wages, etc.) and a maintenance management of the hydraulic excavator or an assessment of price of used excavators, etc.

However, since the hour-meter is provided merely for counting and recording the operating time of the engine, the time during which an operator takes a rest while the engine is being operated is also counted, failing to properly grasp actual labor time of an operator from the recorded content of the hour-meter. Moreover, the content of work done by the hydraulic excavator cannot be known from the recorded content of the hour-meter, thus failing to grasp whether or not the content of work participated by operators is one which requires a high degree of skill, for example. Accordingly, it is difficult to properly perform the personnel (labor) management of operators from the recorded content of the hour-meter.

Further, in performing maintenance of parts-replacement of a hydraulic excavator, a hydraulic excavator by which a heavy load work, for example, such as digging work, is frequently performed is greatly different from a hydraulic excavator by which a light load work such as a finishing work is frequently performed in locations and time at which apparatuses wear or deteriorate. For this reason, even if the locations and time at which maintenance of the hydraulic excavator is performed are decided on the basis of the operating time of the engine merely recorded on the hour-meter, it is difficult to perform the proper maintenance with respect to the individual hydraulic excavators having multifarious working records.

Further, since the time and locations at which apparatuses wear or deteriorate are different according to the content of work done by the hydraulic excavator, as mentioned above, even if the assessment of price of used hydraulic excavators is made on the basis of the operating time of the engine merely recorded on the hour-meter, it has been difficult to make a proper assessment of price.

For solving the problems as noted above, a discrimination of classifications of works of a hydraulic excavator is a first factor. It is a first object of the present invention to provide an apparatus for detecting operating amounts of operating levers and discriminating classifications of works merely from the operating amounts, without adding a special sensor.

It is a second object of the present invention to provide a control apparatus for a hydraulic excavator capable of performing a precise work according to various discriminated classifications of works, without requiring an switch operation by an operator.

It is a third object of the present invention to provide a control apparatus for a hydraulic excavator capable of properly performing a personnel management of operators and a maintenance management of a hydraulic excavator or an assessment of price of used excavators in consideration of working records of the hydraulic excavator.

SUMMARY OF THE INVENTION

For the purpose of achieving the aforementioned objects, according to the present invention, there is provided a control apparatus for a hydraulic excavator in which a plurality of actuators for work including an actuator for a boom, an actuator for an arm, an actuator for a bucket and an actuator for swing are operated according to operation of operating levers corresponding to the actuators for work to perform necessary work, comprising operating-amount detection means for detecting an operating amount of at least one operating lever out of said operating levers corresponding to said actuators for work, feature-amount calculation means for obtaining at least one feature amount indicative of an operating state of said hydraulic excavator for discriminating classifications of works performed using said hydraulic excavator on the basis of the operating amount detected by said operating-amount detection means, and means for discriminating said classifications of works from said feature amount.

Preferably, said means for discriminating classifications of works discriminates at least one classification of work out of a scattering work, a compacting work, a slope finishing work, a crane work, a digging with swing, a loading work, a finishing with swing and an digging work other than said digging with swing using the operating amount detected by said operating-amount detection means.

That is, the operating mode of said operating levers for work corresponding to an actuator for a boom, an actuator for an arm, an actuator for a bucket and an actuator for swing is often peculiar to the classification of work being done. By detection of any of these operating amounts (including the case where all the operating amounts are detected), at least any of classifications of works of a scattering work, a compacting work, a slope finishing work, a crane work, a digging with swing, a loading work, a finishing with swing and an digging work other than said digging with swing can be discriminated.

The simple digging work is a work in which a bucket is pushed to the ground at a position ahead of a hydraulic excavator, and a bucket is pulled this side by operation of an arm and a boom to dig a hole.

The slope finishing work is a work in which a bucket is placed along an inclined plane by simultaneous operation of a bucket, an arm and a boom, in which state the arm and the boom are operated so that the inclined plane is shaved by the bucket.

The ditch digging work is a work in which a bucket is pushed to the ground at a position ahead of a hydraulic excavator, and a bucket is pulled this side by operation of an arm and a boom to dig a ditch.

The horizontal digging work is a work in which a bucket is pushed to the convex area of the ground at a position ahead of a hydraulic excavator, and the bucket is pulled this side by operation of an arm and a boom to shave off the convex area.

The finishing with swing is a work in which a bucket is brought into contact with the ground, in which state the finishing with swing is performed to effect the finishing with dig.

The compacting work is a work in which a boom is repeatedly moved up and down to throw a bucket against the ground so that the ground is hardened.

The scattering work is a work in which earth is scooped into a bucket by simultaneous operation of a bucket, an arm and a boom, and a work for scattering it by operation of the bucket is repeated at high speeds.

The digging with swing is a work in which in case of digging a ditch in a longitudinal direction of a hydraulic excavator at a position sideways of the vehicle, a bucket is pushed to the ground and pulled while performing the finishing with swing to effect digging.

The crane work is a work in which an article to be transported is hung down on the edge of a bucket through a rope or the like to move the article to be transported.

The loading work is a work in which when a hydraulic excavator is transported, the hydraulic excavator is loaded on a trailer or the like.

More specifically, said means for discriminating classifications of works comprises boom work complicatedness grasping means for grasping, on the basis of the operating amount detected by the operating-amount detection means corresponding to the actuator for boom, the rate at which a variation in increase and decrease of said operating amount occurs within a predetermined time as an amount for indicating complicatedness of boom operation; bucket work complicatedness grasping means for grasping, on the basis of the operating amount detected by the operating-amount detection means corresponding to the actuator for bucket, the rate at which a variation in increase and decrease of said operating amount occurs within a predetermined time as an amount for indicating complicatedness of bucket operation; high speed swing time grasping means for grasping, on the basis of the operating amount detected by the operating-amount detection means corresponding to the actuator for swing, the time at which a magnitude of said operating amount exceeds a predetermined value as a high speed swing time; reverse operating time grasping means for grasping, on the basis of the operating amounts detected by the operating-amount detection means corresponding to the actuator for boom, the actuator for arm and the actuator for bucket, respectively, the time at which the boom operating amount exceeds a predetermined value on the up side of the boom within a predetermined time and the arm operating amount and the bucket operating amount exceed a predetermined value on the arm and bucket pull-in sides as a boom reverse operating time; bucket arm stop time grasping means for grasping, on the basis of the operating amounts detected by the operating-amount detection means corresponding to the actuator for boom, the actuator for arm and the actuator for bucket, respectively, the time at which the boom operating amount exceeds a predetermined value within a predetermined time and the arm operating amount and the bucket operating amount is not more than a predetermined value as a bucket and arm stop time; and at least one grasping means out of boom operation average value grasping means, arm operation average value grasping means and bucket operation average value grasping means for grasping, on the basis of the operating amounts detected by the operating-amount detection means corresponding to the actuator for boom, the actuator for arm and the actuator for bucket, respectively, an average value in magnitude of the operating amounts within a predetermined time as a boom operating-amount average value, an arm operating-amount average value and a bucket operating-amount average value, said work state detection means comprises operating-amount detection means for detecting an operating-amount of said operating lever for work corresponding to said at least one grasping means. Said classification of work discriminating means discriminates a classification of work on the basis of at least one of the amount for indicating complicatedness of boom work grasped by said grasping means, the amount for indicating complicatedness of bucket operation, the high speed swing time, the boom reverse operating time, the bucket and arm stop time, the boom operating-amount average value, the arm operating-amount average value and the bucket operating-amount average value.

That is, out of the operating modes of the operating levers for work corresponding to the actuator for boom, the actuator for arm, the actuator for bucket and the actuator for swing, particularly, the amount for indicating complicatedness of the boom operation, the complicatedness indicating amount high speed swing time of the bucket operation, the boom reverse operating time, the bucket and arm stop time, the boom operating-amount average value, the arm operating-amount average value, the bucket operating-amount average value or a combination of these tend to be peculiar to the classification of work being made.

Accordingly, by grasping the complicatedness indicating amount of boom operation from the operating amount of the operating lever for work, various classifications of works such as the scattering work, the compacting work and the like can be discriminated precisely. If the classifications of works are discriminated precisely, the hydraulic excavator can be operated in the optimum operating mode every classification of work.

More specifically, in the scattering work out of the classifications of works performed by the hydraulic excavator, generally, the operating amount of the operating lever for bucket is frequently increased or decreased as compared with other works. Thus, when the complicatedness indicating amount of the boom operation exceeds a predetermined value, the classification of work discrimination means judges that the scattering work is being made to thereby discriminate the scattering work.

In the compacting work, generally, the operating amount of the operating lever for boom is frequently increased or decreased. The time at which the operating amount of the operating levers for arm and bucket is relatively small as compared with the operating amount of the operating lever for boom is relatively long, and the high speed swing by the operating lever for swing is less performed. When the complicatedness indicating amount of the boom operation is above a predetermined value, the high speed swing time is less than a predetermined time, and the bucket and arm stop time is above a predetermined time, the classification of work discrimination means judges that the compacting work is being done to discriminate the compacting work.

In the slope finishing work, generally, the operating amount of the operating lever for bucket is less frequently increased or decreased. The time at which the operating amount of the operating lever for arm and bucket is relatively small is relatively short. The time at which the operating levers are operated on the pull-in side of the arm or bucket while operating the operating lever for boom on the side in which the boom is moved upward is relatively long. The size of the operating lever for arm or the operating amount of the operating lever for bucket is relatively large on the average. Thus, when the complicatedness indicating amount of the bucket operation is less than a predetermined value, the bucket and arm stop time is less than a predetermined value, the boom reverse operating time is above a predetermined value, and the total value of the average value of the arm operating amount and the average value of the bucket operating amount is above a predetermined value, the classification of work discriminating means judges that the slope finishing work is being done to discriminate the slope finishing work.

In the crane work, generally, the operating amount of the operating lever for boom is frequently increased or decreased while the operating amount of the operating lever for bucket is not frequently increased or decreased. Further, the high speed swing by the operating lever for swing is less performed. The time at which the operating amount of the operating levers for arm and bucket is maintained to be small as compared with the operating amount of the operating lever for boom is relatively short, and the magnitude of the operating amount of the operating lever or the operating lever for bucket is relatively small on the average. Thus, when the complicatedness indicating amount of the boom operation is above a predetermined value, the complicatedness indicating amount of the boom operation is above a predetermined value, the complicatedness indicating amount of the bucket operation is less than a predetermined value, the high speed swing time is less than a predetermined value, the bucket and arm stop time is less than a predetermined value, and the total value of the average value of the arm operating amount and the average value of the bucket operating amount is less than a predetermined value, the classification of work discriminating means judges that the crane work is being done to discriminate the crane work.

In the digging with swing, generally, the high speed swing by the operating lever for swing is relatively frequently performed while the time at which the operating amount of the operating lever for arm or bucket is maintained to be small as compared with the operating amount of the operating lever for boom is relatively short. Further, the magnitude of the operating amount of the operating lever for arm or the operating lever for bucket is relatively large on the average. When the high speed swing time is above a predetermined value, the bucket and arm stop time is less than a predetermined value, and the total value of the average value of the arm operating amount and the average value of the bucket operating amount is above a predetermined value, the classification of work discriminating means judges that the digging with swing is being made to discriminate the digging with swing.

In the loading work, generally, the operating amount of the operating lever for boom or the operating amount of the operating lever for bucket is less frequently increased or decreased. The high speed swing by the operating lever for swing is less performed, and these operating levers are less operated on the pull-in side of the arm or bucket while operating the operating lever for boom on the side in which the boom is moved up. Thus, when the complicatedness indicating amount of the boom operation is less than a predetermined value, the complicatedness indicating amount of the bucket operation is less than a predetermined value, the high speed swing time is less than a predetermined value, and the boom reverse operating time is less than a predetermined value, the classification of work discriminating means judges that the loading work is being done to discriminate the loading work.

In the finishing with swing, generally, the high speed swing by the operating lever for swing is often performed. The time at which the operating amount of the operating lever for arm or bucket is small as compared with the operating amount of the operating lever for boom is relatively long. Further, the magnitude of the operating amount of the operating lever for boom or the operating amount of the operating lever for arm is relatively small on the average. Thus, when the high speed swing time is above a predetermined value, the bucket and arm stop time is above a predetermined value, and the total value of the average value of the boom operating amount and the average value of the arm operating amount is less than a predetermined value, the classification of work discriminating means judges that the finishing with swing is being done to discriminate the finishing with swing.

Further, in the digging works (a simple digging work, a ditch digging work, a horizontal digging work, etc.) other than the aforementioned digging with swing, generally, the magnitude of the operating amount of the operating lever for boom or the operating lever for arm is relatively large on the average. Thus, the total value of the average value of the boom operating amount and the average value of the arm operating amount is above a predetermined value, the classification of work discriminating means judges that the digging work other than the digging with swing is being done to discriminate the digging work.

The complicatedness indicating amount of the boom operation or the bucket operation can be grasped, for example, within a predetermined time, by the number of times in which the operating amount of the operating lever for boom or bucket increases or decreases above or below a predetermined operating amount, the number of times in which the plus and minus of a primary derivative of the operating amount within a predetermined time is switched, or the magnitude of a high frequency component in excess of a predetermined frequency out of a frequency component of the operating amount within a predetermined time.

The second classification of work discriminating method will be described hereinafter.

Even in the same classification of work, the operating mode of operating levers has an irregularity to some extent according to operator's taste, work environments and so on. Accordingly, the aforementioned feature amount of an average value within a predetermined time of the magnitude of the operating amounts of the operating levers has an irregularity to some extent. Therefore, the mere comparison of the feature amount with a predetermined value as previously described possibly leads to an occurrence of the fact that the relation in magnitude between the feature amount and a predetermined value is different, even in the same classification of work according to operator's taste or work environments. In such a case, the classification of work is erroneously discriminated.

According to the second classification of work discriminating method, there is provided a classification of work discriminating apparatus for a hydraulic excavator capable of discriminating various classifications of works with high accuracy without irregularity of the operating mode of the operating levers according to operator's taste or operating environments.

In connection with the above-described proposal, the second classification of work discriminating apparatus comprises an apparatus for discriminating classifications of works at the time of work by a hydraulic excavator in which a plurality of actuators for works including an actuator for boom, an actuator for arm, an actuator for bucket and an actuator for swing are operated in response to operation of operating levers corresponding to the respective actuators for works, said apparatus comprising operating amount detection means for detecting an operating amount of at least one operating lever out of the operating levers corresponding to the actuators for works, feature amount calculating means for obtaining at least one feature amount indicative of an operating state of the hydraulic excavator for discriminating the classification of work on the basis of the operating amount detected by the operating amount detection means, and fitness calculation means for obtaining fitness with respect to the classification of work of each feature amount on the basis of a plurality of membership functions for a fuzzy inference determined in advance corresponding to the feature amount every classification of work to be discriminated from the feature amount obtained by the feature amount calculation means, whereby the classification of work to which the feature amount is most fitted is discriminated as the classification of work done by the hydraulic excavator on the basis of the fitness obtained by the fitness calculation means.

According to the present apparatus, when the work is performed by the hydraulic excavator, the feature amount indicative of the operating state of the hydraulic excavator for discriminating the classification of work is obtained, on the basis of the operating amount of the operating lever detected by the operating amount detection means, by the feature amount calculation means. With respect to the feature amount obtained by the fitness calculation means, the fitness relative to classification of work of the feature amount is obtained on the basis of the membership functions for a fuzzy inference. At this time, the fitness with respect to every classification of work of the feature amount thus obtained is highest with respect to classification of work being done actually and is less than the former with respect to other classifications of works.

Further, the fitness is obtained using the membership functions for a fuzzy inference to indicate fitting properties with respect to the classification of work of the feature amount in the form in which is incorporated irregularity of the operating mode of the operating lever according to operator's taste or work environments. Accordingly, the classification of work to which feature amount is most fitted is discriminated as the classification of work done by the hydraulic excavator on the basis of the fitness obtained by the fitness calculation means whereby various classifications of works can be discriminated with high accuracy without irregularity of the operating mode of the operating lever according to operator's taste or work environments.

In the above-described apparatus, more specifically, the feature amount calculation means obtains the boom operation complicatedness indicating amount indicative of the rate at which the operating amount of the operating lever for boom increases or decreases within a predetermined time, the bucket operation complicatedness indicating amount indicative of the rate at which the operating amount of the operating lever for bucket increases or decreases within a predetermined time, the high speed swing time indicative of the time at which the magnitude of the operating amount of the operating lever for swing exceeds a predetermined value within a predetermined time, the boom reverse operating time indicative of the time at which within a predetermined time, the operating amount of the operating lever for boom exceeds a predetermined value on the up side of the boom, and the operating amounts of the operating levers for arm and bucket exceed a predetermined value on the pull-in sides of the arm and bucket, the bucket and arm stop time indicative of the time at which within a predetermined time, the magnitude of the operating amount of the operating lever for boom is above a predetermined value and the magnitude of the operating levers for arm and bucket is less than a predetermined value, and at least one of the average value of the boom operating amount indicative of the average value of the magnitude of the operating amounts of the operating levers for arm and bucket within a predetermined time, the average value of the arm operating amount and the average value of the bucket operating amount as said feature amount. The operating amount detection means detects the operating amount of the operating lever corresponding to at least one feature amount.

That is, the operating modes of the operating levers corresponding to the actuator for boom, the actuator for arm, the actuator for bucket and the actuator for swing define the operating state of the hydraulic excavator corresponding to the work being done. Out of the operating modes, particularly, the boom operation complicatedness indicating amount, the bucket operation complicatedness indicating amount, the high speed swing time, the boom reverse operating time, the bucket and arm stop time, the average value of the boom operating amount, the average value of the arm operating amount, the average value of the bucket operating amount or a combination of these tend to be peculiar to the classification of work being done. Accordingly, the membership function for defining the fitting properties with the classifications of works of the feature amounts also tend to be peculiar to the set of the feature amounts and classifications of works.

Accordingly, the feature amount of the boom operation complicatedness indicating amount is obtained from the operating amount of the operating lever corresponding to the feature amount, the fitness with respect to the classification of work of the feature amount thus obtained is obtained on the basis of the membership functions, and the classification of work to which the feature amount is most fitted is discriminated as the classification of work done by the hydraulic excavator whereby various classifications of works such as the digging work, the scattering work and the like can be discriminated with high accuracy.

In the present invention, when there are many classifications of works to be discriminated, the fitness is to be obtained every classification of work with respect to the feature amount obtained during the work. This increases the arithmetic load of the fitness calculation means.

On the other hand, for example, in the scattering work out of the classifications of work done by the hydraulic excavator, generally, the operating lever for bucket frequently increases or decreases at short intervals, and the trend of the operating mode of the operating lever for bucket is hardly affected by operator's taste or work environments and appears conspicuously as compared with other classifications of works.

Further, for example, in the compacting work, generally, the operating amount of the operating lever for boom frequently increases or decreases at short intervals. The time at which the operating amount of the operating lever for bucket is small as compared with that of the operating lever for boom is relatively long, and the high speed swing by the operating lever for swing is less performed The trend of the operating mode of the operating lever is hardly affected by operator's taste or work environments and appears conspicuously as compared with other classifications of works.

Further, in the present apparatus, the feature amount obtained by the feature amount calculation means includes the bucket operation complicatedness indicating amount. When the bucket operation complicatedness indicating amount exceeds a predetermined value, the classification of work done by the hydraulic excavator is discriminated as the scattering work without the fitness obtained by the fitness calculation means.

The feature amount obtained by the feature amount calculation means includes the boom operation complicatedness indicating amount, the bucket and arm stop time, and the high speed swing time. When the boom operation complicatedness indicating amount is above a predetermined value, the bucket and arm stop time is above a predetermined value and the high speed swing time is less than a predetermined value, the classification of work done by the hydraulic excavator is discriminated as the compacting work without the fitness obtained by the fitness calculation means.

As described above, the bucket operation complicatedness indicating amount, the boom operation complicatedness indicating amount, the bucket and arm stop time, and the high speed swing time are compared with a predetermined value, and when the magnitude relation is fulfilled with the above-described conditions, the classification of work being done is discriminated as the scattering work or the compacting work. With this arrangement, in the discrimination of classifications of work, it is not necessary to obtain the fitness with respect to the individual classification of work of the feature amount, and it is possible to discriminate the scattering work or the compacting work with high accuracy without obtaining the fitness.

Accordingly, various classifications of works can be discriminated with high accuracy while suitably reducing the arithmetic load of the fitness calculation means.

For the purpose of achieving the aforementioned second object, according to the present invention, there is provided a control apparatus for a hydraulic excavator having an engine and a variable displacement hydraulic pump driven by the engine, in which a plurality of actuators for work including an actuator for a boom, an actuator for an arm, an actuator for a bucket and an actuator for swing are operated according to operation of operating levers corresponding to the actuators for work to perform necessary work, comprising engine speed control means, pump discharge control means, and an actuator for work operated according to the operation of the operating lever for work by discharge of said hydraulic pump, operating amount detection means for detecting an operating amount of at least one operating lever out of the operating levers corresponding to said actuators for work, feature amount calculation means for obtaining at least one feature amount indicative of the operating state of said hydraulic excavator for discriminating classifications of works being performed by said hydraulic excavator on the basis of the operating amount detected by said operation amount detection means, means for discriminating said classifications of works from said feature amount, and operating mode control means for controlling at least one operation out of the engine speed and said pump discharge corresponding to said classifications of works.

Accordingly, the classification of work is automatically discriminated from the operating state of the actuators for work, and the actuators for work is controlled in the operating mode adapted to the classification of work thus discriminated. It is therefore possible to precisely perform work according to various classifications of works without requiring the switch operation by an operator.

That is, in the present invention for discriminating various classifications of works, the operating mode control means comprises means for setting at least one of a hydraulic pump absorbing horse power which is the rate for absorbing an output of the engine by the hydraulic pump, the maximum discharge of working fluid to the actuator for work from the hydraulic pump, a discharge rate of change of working fluid to the actuator for work with respect to a change of the operating amount of the operating lever corresponding to the actuator for work, and a response time constant of the actuator for work with respect to the operation of the operating lever corresponding to the actuator for work, as the operating mode of the apparatus for work according to the classification of work discriminated by the classification of work discriminating means, and the apparatus for work is controlled in accordance with the operating mode set.

Further, there is provided auto acceleration means for controlling the engine to a predetermined low speed engine speed when work stops in which the operating lever of the actuator for work is at a neutral position. The operating mode control means controls the auto acceleration means to an operating state or a non-operating state according to the classification of work discriminated by the classification of work discriminating means.

As described above, the hydraulic pump absorbing horse power, the maximum discharge of working fluid, the discharge rate of change of working fluid and the response time constant are set, and the auto acceleration means is placed in the operating state or non-operating state. Thereby, the engine output can be used efficiently according to the classification of work, and the response of the actuator for work with respect to the change of the operating amount of the operating lever, the maximum operating speed of the actuator for work and the operating speed of the actuator for work with respect to the change of the operating amount of the operating lever can be made suitable for the classification of work. Further, it is possible to automatically actuate or release the function of the auto acceleration means precisely according to the classification of work. Thereby, various works can be performed by the work of the hydraulic excavator in the mode adapted to the classification of work thereof.

More specifically, in the case where at least the digging work and works other than the former are classified by the classification of work discriminating means for discrimination, when the hydraulic pump absorbing horse powder is set and controlled, the operating mode control means is provided with absorbing horse power setting means for setting the hydraulic pump absorbing horse power according to the classification of work discriminated, and hydraulic pump control means for controlling the hydraulic pump according to the absorbing horse power set, whereby when the classification of work discriminated is the digging work, the hydraulic pump absorbing horse power is set larger than that of works other than the digging work.

Alternatively, in the case where at least one out of the crane work and the loading work, and works other than the former are classified by the classification of work discriminating means for discrimination, the operating mode control means is provided with absorbing horse power setting means and hydraulic pump control means similar to the above, whereby when the classification of work discriminated is either the crane work or the loading work, the hydraulic pump absorbing horse power is set smaller than that of works other than these works.

With this arrangement, in the digging work or the like in which the load of the actuator for work is relatively large, the output of the engine is sufficiently absorbed into the hydraulic pump, which can be transmitted to the actuator for work. Conversely, in the crane work and the loading work in which the load of the actuator for work is relatively small, the output of the engine can be set to a limit as required to enhance a fuel cost of the engine.

In the case where the digging work is discriminated, the hydraulic pump absorbing horse power is set so that the output torque in the engine speed matches that of the hydraulic pump, whereby the output of the engine is drawn to the maximum limit for the digging work. When many kinds of classifications of works are discriminated, plural kinds of the hydraulic pump absorbing horse powers may be set according to the classifications of works.

Alternatively, in the case where at least either the digging work or the finishing with swing is classified by the classification of work discriminating means for discrimination, when the maximum discharge of working fluid is set and controlled, the operating mode control means is provided with maximum discharge setting means for setting the maximum discharge of working fluid according to the classification of work discriminated, and hydraulic pump control means for controlling the discharge of the hydraulic pump to a value less than the maximum discharge set, whereby when thus discriminated classification of work is either the digging work or the finishing with swing, the maximum discharge is set larger than that of works other than the former.

Alternatively, in the case where at least one out of the crane work and the loading work, and works other than the former are classified by the classification of work discriminating means for discrimination, the operating mode control means is provided with maximum discharge setting means for setting the maximum discharge of working fluid according to the classification of work discriminated and hydraulic pump control means for controlling the discharge of the hydraulic pump to a value less than the maximum discharge set, whereby when the classification of work discriminated is either the crane work or the loading work, the maximum discharge is set smaller than that of works other than these works.

With this arrangement, in the digging work and the finishing with swing for which a relatively high speed of an actuator for work is required, if an operating lever for work is manipulated for its maximum operating amount, an operating speed necessary for the actuator for work can be obtained. Conversely, in the crane work and the loading work for which a relatively low speed of an actuator for work is required, even if an operating lever for work is manipulated for its maximum operating amount, it is possible to eliminate the situation such that the actuator for work is operated at higher operating speed than as necessary.

When either digging work or finishing with swing is discriminated, the maximum discharge is set to a predetermined maximum discharge of the hydraulic pump, whereby the maximum-limit operating speed of the actuator for work can be obtained. When many kinds of classifications of works are discriminated, plural kinds of the maximum supply amounts may be set according to the classifications of works.

In the case where at least one out of the digging work, the compacting work and the scattering work, and works other than the former are classified by the classification of work discriminating means for discrimination, when a discharge rate of change of working fluid is set, the operating mode control means is provided with discharge characteristic setting means set according to the classification of work for which the discharge rate of change of working fluid is discriminated, and hydraulic pump control means for controlling the hydraulic pump in accordance with the discharge rate of change set, whereby when the classification of work discriminated is either the digging work, the compacting work or the scattering work, the discharge rate of change is set larger than that of works other than the former.

Or, there is provided means for classifying and discriminating the classifications of work into at least one of the crane work and the loading work and works other than the former by the classification of work discriminating means being provided with discharge rate of change setting means for setting the discharge rate of change of working fluid to the actuator for work with respect to change of the operating amount of the operating lever corresponding to the actuator for work, and hydraulic pump control means for controlling the hydraulic pump in accordance with the discharge rate of change set, whereby when the classification of work discriminated is either crane work or loading work, the discharge characteristic setting means set the discharge rate of change smaller than that of works other than the former.

With this arrangement, in the digging work, the compacting work and the scattering work for which a relatively large change of the operating speed of the actuator for work with respect to the change of the operating amount of the operating lever for work, the operating speed of the actuator for work can be sufficiently changed merely by changing the operating amount of the operating lever for work slightly. Conversely, in the crane work and the loading work for which a small change of the operating speed of the actuator for work with respect to the change of the operating amount of the operating lever for work, a fine speed work of the actuator for work can be performed.

When many kinds of classifications of works are discriminated, plural kinds of the maximum supply amount may be set according to the classifications of works. In the case where in the case where at least either the compacting work or the scattering work, and works other than the former are classified by the classification of work discriminating means for discrimination, when the response time constant is set and controlled, the operating mode control means is provided with time constant setting means for setting the response time constant according to the classification of work discriminated and hydraulic pump control means for controlling the hydraulic pump in accordance with the time constant set, whereby when the classification of work is either the compacting work or the scattering work, the response time constant is set smaller than that of works other than the former.

In the case where at least one of the crane work, the loading work and the slope finishing work, and works other than the former are classified by the classification of work discriminating means for discrimination, the operating mode control means is provided with time constant setting means for setting the response time constant according to the classifications of works, and hydraulic pump control means for controlling the hydraulic pump in accordance with the time constant set, whereby when the classification of work is either the crane work, the loading work or the slope finishing work, the response time constant is set larger than that of works other than the former.

In the compacting work and the scattering work for which a rapid responsibility of the actuator for work with respect to the operation of the operating lever for work, the responsibility as requested is obtained and the rapid work can be performed. Conversely, in the crane work, the loading work and the slope finishing work for which a relatively gentle responsibility of the actuator for work with respect to the operation of the operating lever for work, even if the operating amount of the operating lever for work is primarily varied, it is possible to avoid the situation that the actuator for work becomes operated accordingly, and the work can be made at the stable operating speed of the actuator for work.

When either compacting work or scattering work is discriminated, the response time constant is set to zero, whereby the work of the actuator for work following it can be obtained extremely rapidly.

In the case where the auto acceleration means is provided, and at least one of the crane work and the loading work and works other than the former are discriminated by the classification of work discriminating means for discrimination, when the classification of work discriminated is either crane work or loading work, the auto acceleration means is controlled to the non-operating state, and when the classification of work is works other than the crane work and the loading work, the auto acceleration means is controlled to the operating state.

That is, in the crane work and the loading work, all the operating levers for works are often operated to a neutral position similar to the case where work stops during the work. In such a case, it is not preferable that the engine speed is controlled to a predetermined low speed against intention of an operator by the auto acceleration means. So, when the classification of work discriminated is either crane work or loading work, the auto acceleration means is placed in the non-operating state to thereby avoid the situation in which the rotational speed of the engine is controlled to a predetermined low speed against intention of an operator during the work. In the case of works other than the crane work and the loading work, the auto acceleration means is placed in the operating state whereby when the work stops, the engine speed can be automatically controlled to the low speed to improve the fuel cost.

According to a first aspect of control apparatus for a hydraulic excavator of the present invention for achieving the third object, there is provided control apparatus for a hydraulic excavator comprising operating amount detection means for detecting an operating amount of an operating lever for operating an actuator for work, feature amount calculation means for obtaining a predetermined feature amount indicative of an operating state of the hydraulic excavator for discriminating the content of work being done by the hydraulic excavator from the operating amount of the operating lever detected by the operating amount detection means, and classification of work discriminating means for discriminating the classification of work of the hydraulic excavator every predetermined time on the basis of the feature amount obtained by the feature amount calculation means, and memory means for readably storing and retaining the content of work discriminated by the classification of work discriminating means.

According to the aforementioned first aspect, since the content of work of the hydraulic excavator discriminated every predetermined time by the classification of work discriminating means is readably stored and retained in the memory means, whereby the stored content of the memory means can be read to grasp the record of work of the hydraulic excavator. Thereby, the personnel management of operators, the management of maintenance of a hydraulic excavator or the assessment of price of used excavators can be performed properly in consideration of operating records of the hydraulic excavator.

Preferably, the memory means stores and retains the content of work in terms of time series. With this arrangement, it is possible to grasp the operating records of the hydraulic excavator including time records of classifications of works performed by the hydraulic excavator. Further, it is possible to precisely perform the personnel management, the management of maintenance of a hydraulic excavator or the assessment of price of used excavators.

According to a second aspect of control apparatus for a hydraulic excavator of the present invention for achieving the third object, there is provided control apparatus for a hydraulic excavator comprising operating amount detection means for detecting an operating amount of an operating lever for operating an actuator for work, feature amount calculation means for obtaining a predetermined feature amount indicative of an operating state of the hydraulic excavator for discriminating the content of work being done by the hydraulic excavator from the operating amount of the operating lever detected by the operating amount detection means, and classification of work discriminating means for discriminating the classification of work of the hydraulic excavator every predetermined time on the basis of the feature amount obtained by the feature amount calculation means, operating time integrating means for integrating the operating time every classification of work discriminated by the classification of work discriminating means, and memory means for readably storing and retaining the operating time every classification of work obtained by the operating time integrating means.

According to the second aspect, since the operating time is integrated every classification of work discriminated by the classification of work discriminating means and then readably stored and held in the memory means, the stored content of the memory means can be read to grasp the operating time every classification of work of the hydraulic excavator. Further, since the operating time every classification of work can be grasped as described above, it is possible to precisely perform the personnel management, the management of maintenance of a hydraulic excavator or the assessment of price of used excavators.

In the aforementioned first or second aspect, the classifications of works to be discriminated by the classification of work discriminating means include at least one classification of work out of the non-operating state of a hydraulic excavator, the travel operating state, the simple digging work, the ditch digging work, the horizontal digging work, the finishing with swing, the compacting work, the scattering work, the digging with swing, the crane work and the loading work. The non-operating state of a hydraulic excavator means the state in which all the actuators stop the works. The travel operating state means the state in which the travel work is performed with at least one of actuators for right and left travel while stopping actuators for work other than the actuators for right and left travel.

According to the aforementioned first or second aspect, the feature amount calculation means obtains at least one, as a feature amount, out of a indicating amount of boom operation complicatedness indicative of the rate in which an operating amount of an operating lever for boom produces a variation in increase or decrease within a predetermined time, an operating amount of bucket operation complicatedness indicative of the rate in which an operating amount of an operating lever for bucket produces a variation in increase or decrease, a high speed swing time indicative of the time at which the magnitude of an operating lever for swing exceeds a predetermined value within a predetermined time, a boom reversing operating time indicative of the time at which an operating amount of an operating lever for boom exceeds a predetermined value and operating amounts of operating levers for arm and bucket exceed a predetermined time on the arm and boom pull-in sides within a predetermined time, a bucket and arm stop time indicative of the time at which the magnitude of an operating amount of an operating lever for boom exceeds a predetermined value and the magnitude of operating amounts of operating levers for arm and bucket is less than a predetermined value within a predetermined time, an average value of an operating amount for boom indicative of an average value of magnitudes of operating amounts of operating levers for boom, for arm, for bucket and for swing and for right travel and left travel, an average value of an operating amount for arm, an average value of an operating amount for bucket, an average value of an operating amount for swing, and an average value of an operating amount for right travel and an average value of an operating amount for left travel. The operating amount detection means detects the operating amount of the operating lever corresponding to at least one feature amount.

That is, the operating modes of the operating levers corresponding to the actuators for work, i.e., the actuator for boom, the actuator for arm, the actuator for bucket, the actuator for swing, the actuator for right travel and the actuator for left travel define the operating state of the hydraulic excavator corresponding the work being performed. Out of the operating modes, particularly, the indicating amount of boom operation complicatedness, the indicating amount of bucket operation complicatedness, the high speed swing time, the boom reversing operating time, the bucket and arm stop time, the average value of the operating amount for boom, the bucket and arm stop time, the average value of the operating amount for boom, the average value of the operating amount for arm, the average value of the operating amount for bucket, the average value of the operating amount for swing, the average value of the operating amount for right travel, the average value of the operating amount for left travel or a combination thereof has a trend to be peculiar to the content of work being done.

Accordingly, the classifications of works of the hydraulic excavator can be properly discriminated on the basis of the feature amounts such as the indicating amount of boom operating complicatedness.

BRIEF DESCRIPTION OF THE DRAWINGS

FIG. 14 is a flowchart for explaining the work of the first classification of work discriminating method;

FIG. 19 is an explanatory view for explaining data stored in memory means; and FIG. 20 is an explanatory view for explaining data stored in memory means.

DESCRIPTION OF THE PREFERRED EMBODIMENTS

Preferred embodiments of the present invention will be described hereinafter with reference to FIGS. 1 to 20.

Figure 1:
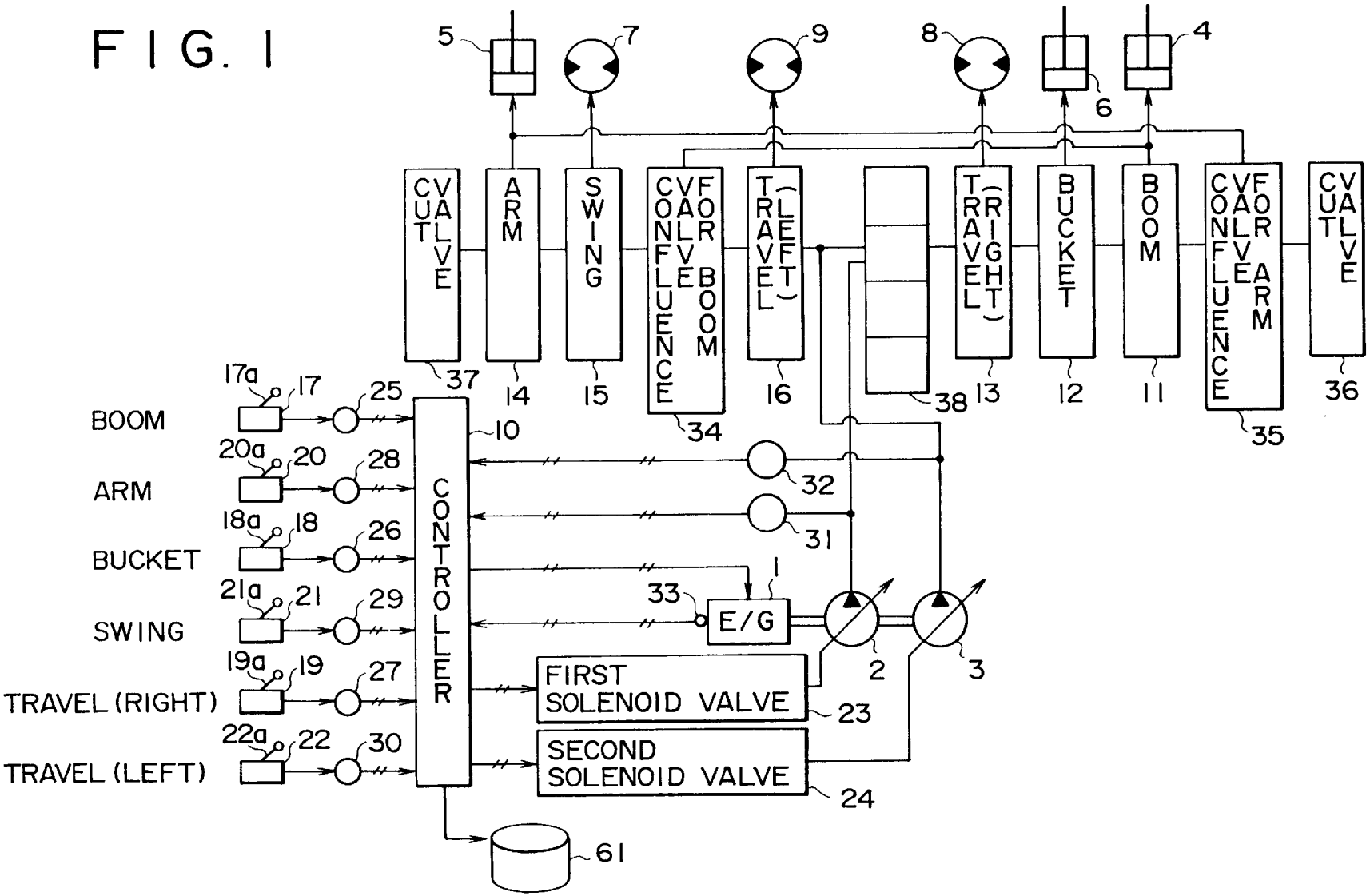
FIG. 1 is a structural view of the entire system of a hydraulic excavator according to one embodiment of the present invention.

Referring to FIG. 1, the hydraulic excavator according to the present embodiment comprises, as equipment for work, an engine 1, two hydraulic pumps 2, 3 driven by the engine 1, an actuator 4 for boom (a hydraulic cylinder) as an actuator for work, an actuator 5 for arm (a hydraulic cylinder), an actuator 6 for bucket (a hydraulic cylinder), an actuator 7 for swing (a hydraulic motor), an actuator 8 for right travel (a hydraulic motor) and an actuator 9 for left travel (a hydraulic motor), and further comprises a controller 10 for controlling an operating mode (an operating characteristic) of these equipment for work.

The hydraulic pump 2 is provided to supply working fluid to the actuator 4 for boom, the actuator 6 for bucket and the actuator 8 for right travel, out of the actuators for work to operate the same. The hydraulic pump 2 is connected to the actuators 4, 6 and 8 through a control valve 11 for boom, a control valve 12 for bucket and a control value 13 for right travel which are in the form of a direction switching valve.

The hydraulic pump 3 is likewise provided to supply working fluid to the actuator 5 for arm and the actuator 9 for left travel to operate the same. The hydraulic pump 3 is connected to the actuators 5, 7 and 9 through a control valve 14 for arm, a control valve 15 for swing and a control value 16 for left travel.

Pilot pressure according to an operating amount and an operating direction of operating levers 17 to 22 is supplied to the control valves 11 to 16 form pilot valves (not shown) of operating devices 17*a* to 22*a* provided with an operating lever 17 for boom, an operating lever 18 for bucket, an operating lever 19 for right travel, an operating lever 20 for arm, an operating lever 21 for swing and an operating lever 22 for left travel, respectively, for switching operation.

In the drawing, the operating levers 17 to 22 are shown so as to be individually provided for the sake of convenience. Actually, however, the operating lever 17 for boom and the operating lever 18 for bucket are composed of a single operating lever so that the work of the individual actuators 4 and 6 is performed by the operation of the operating lever in a longitudinal direction and the work thereof in a lateral direction. The operating lever 20 for arm and the operating lever 21 for swing are likewise composed of a single operating lever.

The hydraulic pumps 2 and 3 are of the variable displacement type, whose inclination can be adjusted through a regulator (not shown) by secondary pressure produced by a first proportional solenoid valve 23 and a second proportional solenoid valve 24. The proportional solenoid valves 23 and 24 each produce the secondary pressure according to the energizing amount, and the discharge of the hydraulic pumps 2 and 3 can be controlled by energizing and controlling the proportional solenoid valves 23 and 24. The energizing and controlling of the proportional solenoid valves 23 and 24 are performed by means of the controller 10 as will be described later.

On the other hand, the hydraulic excavator according to the present embodiment comprises a boom operating-amount sensor 25, a bucket operating-amount sensor 26, a right travel operating-amount sensor 27, an arm operating-amount sensor 28, a swing operating-amount sensor 29 and a left travel operating-amount sensor 30 for detecting the operating amounts (including the operating directions) of the operating levers 17 to 21 as the amounts indicative of the operating states of the actuators 4 to 9, respectively, the operating-amount sensors 25 to 30 outputting a signal corresponding to the operating amounts of the operating levers 17 to 21 to the controller 10. There are further provided pressure sensors 31 and 32 for detecting discharge pressures (load pressures) of the hydraulic pumps 2 and 3 and an engine speed sensor 33 for detecting engine speed, the pressure sensors 31, 32 and the engine speed sensor 33 outputting the discharge pressures of the hydraulic pumps 2, 3 and a signal corresponding to the engine speed.

In this case, the operating-amount sensors 25 to 30 are composed of pressure sensors, and the operating devices 17*a* to 22*a* provided with the operating levers 17 to 21 detect pilot pressures, which indicate the operating amounts, produced corresponding to the operating amounts of the operating levers 17 to 21.

In FIG. 1, in the present embodiment, discharge of the hydraulic pump 3 is suitably merged into discharge of the hydraulic pump 2 and supplied to the actuator 4 for boom through a confluence valve 34 for boom provided on a pipeline on the side of the hydraulic pump 3. Similarly, discharge of the hydraulic pump 2 is suitably merged into discharge of the hydraulic pump 3 and supplied to the actuator 5 for arm through a confluence valve 35 for arm provided on a pipeline on the side of the hydraulic pump 2.

In the case where the actuator 4 for boom, the actuator 6 for bucket and the actuator 8 for right travel are in the non-operating state, the discharge of the hydraulic pump 2 is circulated to an oil tank not shown through a cut valve 36, the cut valve 3 cutting a circulating flow when any of the actuators 4, 6 and 8 is operated. A cut valve 37 similar to the former is provided also on the side of the hydraulic pump 3.

In FIG. 1, reference numeral 38 designates a valve by which working fluid of the same flow rate is supplied from the hydraulic pumps 2 and 3 to the actuator 8 for right travel and the actuator 9 for left travel when the hydraulic excavator runs straight.

Figures 2, 2A, 2B:
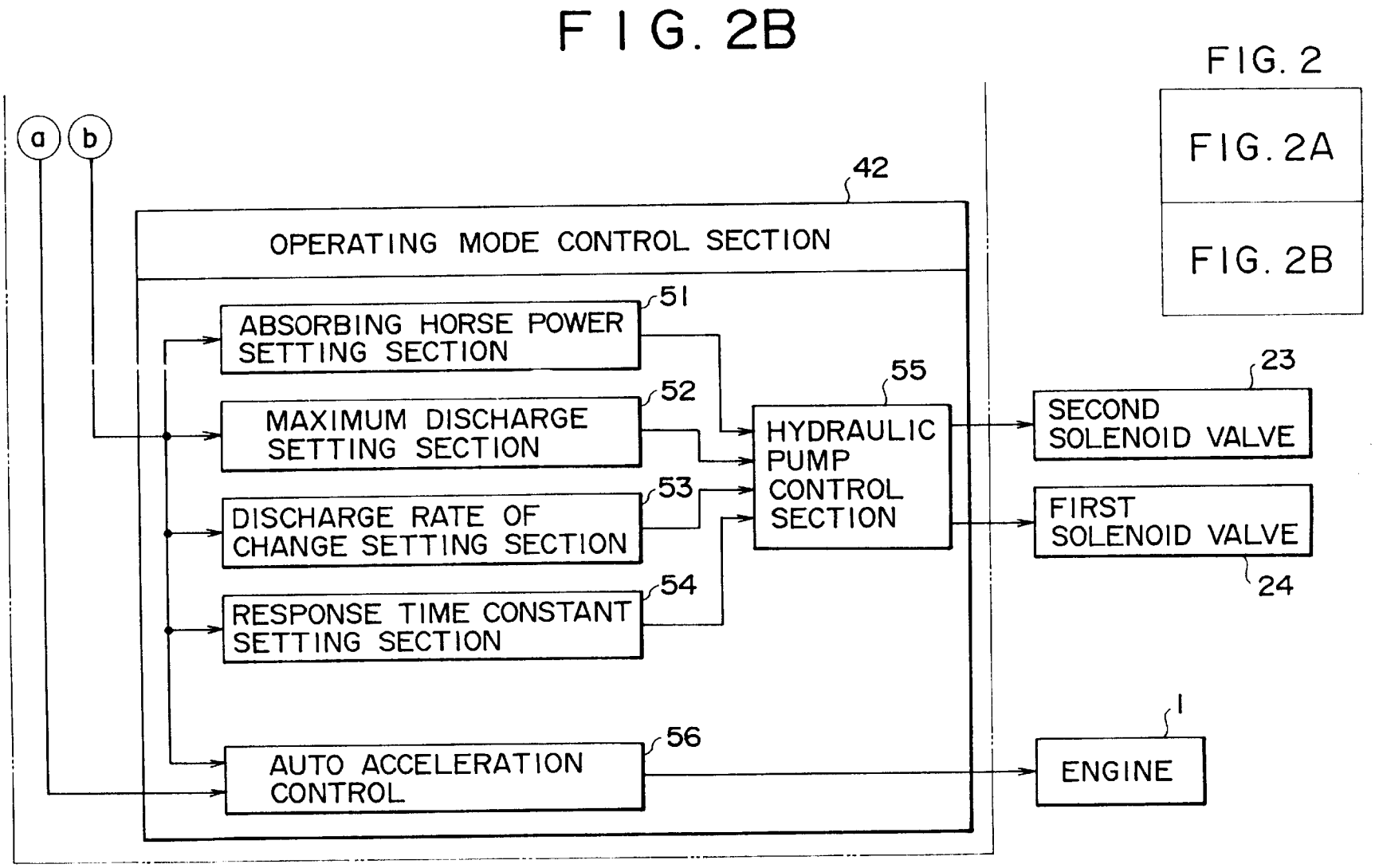
FIG. 2 is a structural view of a block of a control apparatus for a hydraulic excavator shown in FIG. 1.
Figure 3:
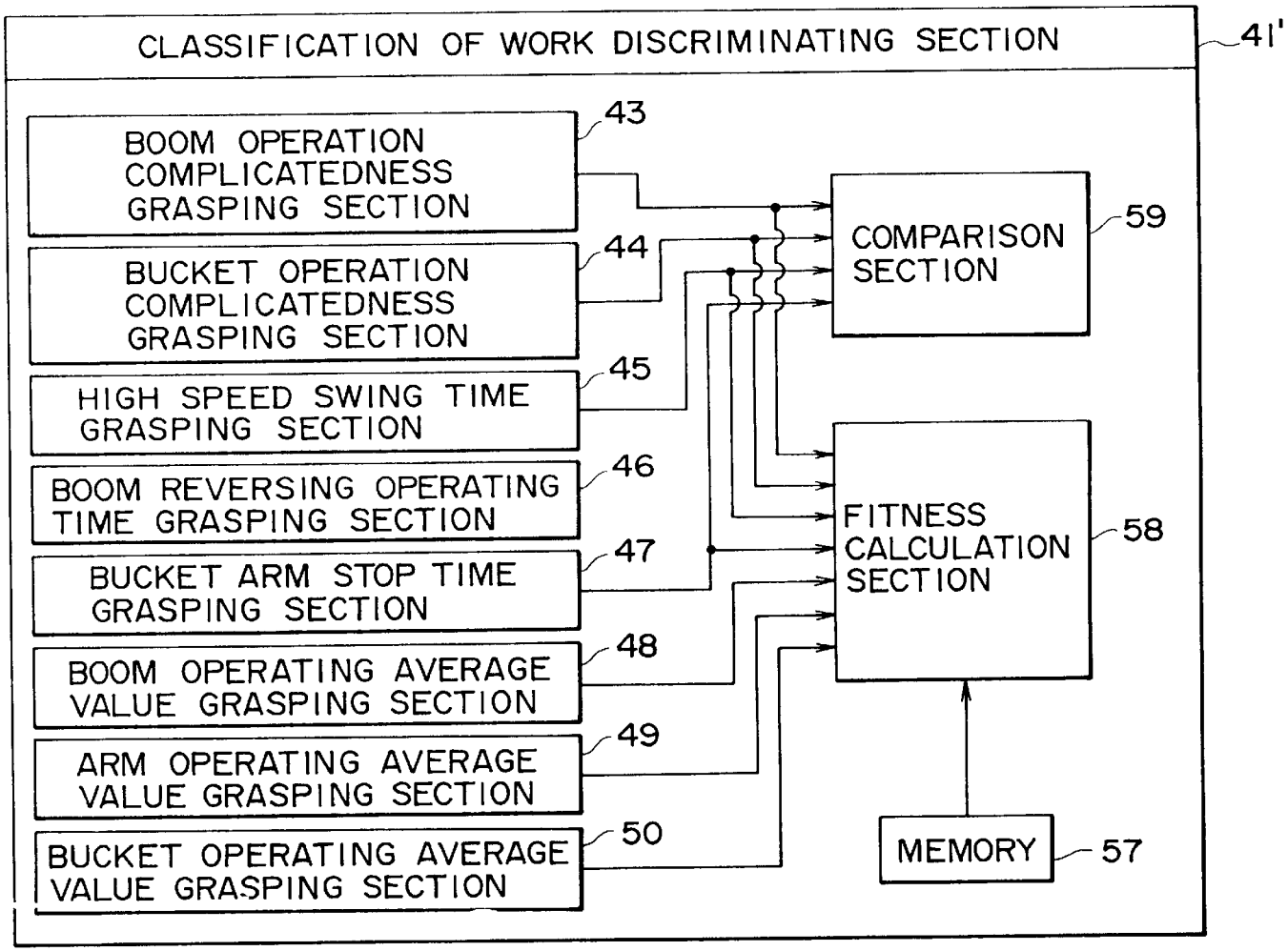
FIG. 3 is a structural view of a block of a classification of work discriminating section in case of a second classification of work discriminating method.

Tuning now to FIG. 2, the controller 10 is composed of a microcomputer, which comprises, as a functional structure, an AID converter 39 for AID converting output signals of the operating-amount sensors 25 to 30, a data retaining section 40 for retaining data indicative of the operating amounts of the A/D converted operating levers 17 to 21, a classification of work discriminating section 41 for discriminating classifications of works being performed by the hydraulic excavator on the basis of the data retained, an operating mode control section 42 for setting operating modes of the hydraulic pumps 2, 3 and the engine 1 corresponding to the classifications of works discriminated to control the work of the hydraulic pumps 2, 3 and the engine 1 accordingly, and an operating time integrating section 60 (operating time integrating means) for integrating the operating time every content of work to be discriminated. To the controller 10 is connected a hard disk 61 as recording means for recording records of the contents of work discriminated and the operating time.

The data retaining section 40 retains data indicative of the operating amounts of the operating levers 17 to 21 obtained from the operating-amount sensors 25 to 30 through the A/D converter 39 for a continuous predetermined time (for example, 20 seconds) to update it every 5 seconds, for example.

The classification of work discriminating section 41 comprises, for discriminating the classifications of works, a boom-operation complicatedness grasping section 43 for grasping plural kinds of feature amounts described later from operating-amount data for a part for a predetermined time of the operating levers 17 to 21 retained by the data retaining section 40, a bucket operation complicatedness grasping section 44, a high speed swing time grasping section 45, a boom reversing operating time grasping section 46, a bucket arm stop time grasping section 47, a boom operating average value grasping section 48, an arm operating average value grasping section 49 and a bucket operating average value grasping section 50, and discriminates the classifications of works on the basis of the feature amounts grasped by the grasping sections 43 to 50, as will be described later.

The operating time integrating section 60 cumulatively integrates and retains the time required for discrimination of contents of works every 12 kinds of operating contents discriminated by the operating content discriminating section 42. More specifically, in the present embodiment, the present operating content is discriminated by the operating content discriminating section 42 every time data retained by the data retaining section 40 is updated for a period of 15 seconds, and with respect to the operating contents, time of 15 seconds is added to an integrated value of the operating time retained at present corresponding to the content of work every time the content is discriminated.

The controller 10 writes the contents of work discriminated together with time data (for example, passage time from the reference date d time set in advance to the present time, for example, such as the manufactured date and time of a hydraulic excavator) into the hard disk 44 in terms of time series every time the content of work is discriminated. In this case, the time data is grasped by a dock not shown provided on the controller 10. At this time, the controller 10 further writes into the hard disk 61 the integrated value of the operating time every content of work obtained by the operating time integrating section 60.

The hard disk 61 can read the recorded contents by connecting a personal computer or the like not shown thereto.

The boom operation complicatedness grasping section 43 grasps the rate in which the operating amount of the operating lever 17 varies in increase or decrease within a predetermined time as a complicatedness indicating amount (hereinafter, indicated by reference symbol ch1) indicative of the complicatedness of the boom operation from data of operating amount for a part for a predetermined time of the operating lever 17 for boom. The bucket operation complicatedness grasping section 44 grasps the rate in which the operating amount of the operating lever 18 varies in increase or decrease within a predetermined time as a complicatedness indicating amount (hereinafter, indicated by reference symbol ch2) indicative of the complicatedness of the boom operation from data of operating amount for a part for a predetermined time of the operating lever 18 for bucket.

Figure 4:
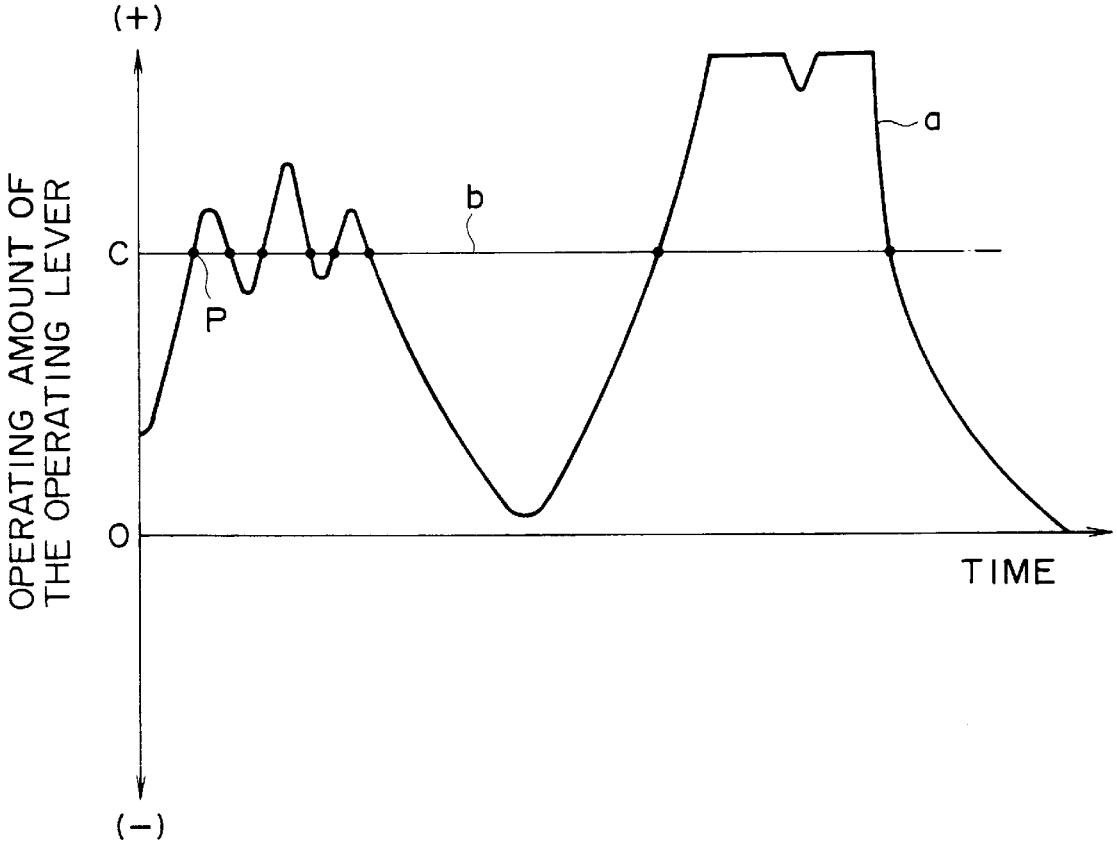
FIG. 4 is a diagram for explaining means for grasping complicatedness of work.

More specifically, referring to FIG. 4, in the present embodiment, the boom operation complicatedness grasping section 43 obtains, as the complicatedness indicating amount ch1 of the boom operation, the number of intersections P at which a waveform a (which corresponds to data in terms of time series for a part for a predetermined time of the data of the operating amount retained by the data retaining section 40) indicative of change in time of the operating amount of the operating lever 17 for boom for a part for a predetermined time intersects a straight line b indicative of a predetermined operating amount C determined in advance, that is, the number of times in which the operating amount of the operating lever 17 for boom changes from the operating amount smaller or larger than the predetermined operating amount to the operating amount larger or smaller than the predetermined operating amount (the number of times which changed above or below the predetermined operating amount). This is exactly true for the bucket operation complicatedness grasping section 44.

The predetermined operating amount C is determined separately in operating directions on positive and negative sides of the operating lever 17 for boom and the operating lever 18 for arm, and is determined separately every operating levers 17, 18.

Alternative method for grasping the operation complicatedness will be described hereinafter with reference to FIG. 5.

In the complicatedness grasping method, the boom operation complicatedness grasping section 43 obtains, every predetermined operating amounts S1–S5, the number of intersections P1–P5 at which a waveform a (which corresponds to data in terms of time series for a part for a predetermined time of the data of the operating amount retained by the data retaining section 40) indicative of change in time of the operating amount of the operating lever 17 for boom for a part for a predetermined time (20 seconds) intersects straight lines b1–b5 indicative of a plurality of predetermined operating amounts S1–S5 determined in advance, that is, the number of times in which the operating amount of the operating lever 17 for boom changes from the operating amount smaller or larger than the predetermined operating amounts S1–S5 to the operating amount larger or smaller than the predetermined operating amounts S1–S5 (the number of times which changes above or below the predetermined operating amounts S1–S5). An average value of the number of intersections P1–P5 corresponding to the predetermined operating amounts S1–S5 is obtained as the complicatedness indicating amount of the boom operation.

Figure 5:
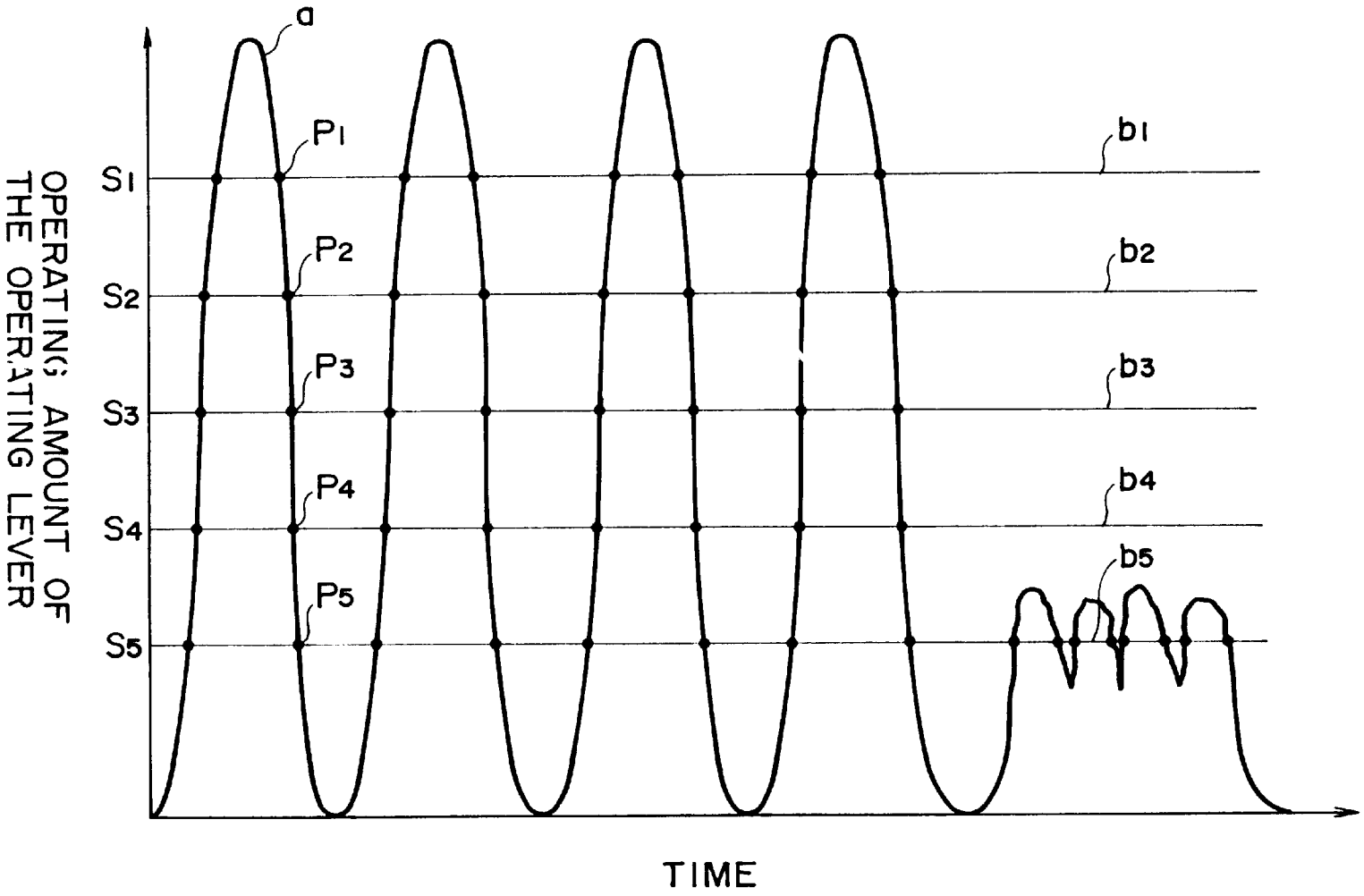
FIG. 5 is a diagram for explaining means for grasping complicatedness of work.

For example, in the waveform a of the operating amount of the operating lever 17 for boom shown in FIG. 5, the number of the intersections P1–P5 relative to the straight lines b1–b5 corresponding to the predetermined operating amounts S1–S5 are 8, 8, 8, 8 and 16, respectively. In this case, the complicatedness indicating amount of the boom operation is "9.6".

The method for obtaining the complicatedness indicating amount as described will exactly apply to the bucket operation complicatedness grasping section 44. Here, the predetermined operating amounts S1–S5 are determined every operating levers 17, 18.

Further, in this case, the average value of the number of the intersections P1–P5 relative to the straight lines b1–b5 corresponding to the plurality of predetermined operating amounts S1–S5 is made as the complicatedness indicating amount of the boom operation and the bucket operation whereby even in the case where the range of increase or decrease in the operating amounts of the operating levers 17, 18 becomes irregular due to operator's taste or work environment during the same operation, a degree (complicatedness of operation) at which the operating levers 17, 18 are frequently increased or decreased can be properly grasped. Further, as shown at the portion close to right-hand in FIG. 5, in the case where the operating amount of the operating levers 17, 18 increase or decreases in a slight range of increase or decrease due to mere vibrations, the situation can be eliminated in misconception in which the operating levers 17, 18 are frequently operated in increase or decrease.

Alternatively, with respect to the complicatedness indicating amount as described, the minimum value of the number of the intersections P1–P5 may be obtained as the complicatedness indicating amount. In such a case, in the waveform a shown in FIG. 5, the complicatedness indicating amount is "8".

The complicatedness indicating amounts ch1, ch2 of the boom operation and the bucket operation obtained as described above indicate a degree at which the operating lever 17 for boom and the operating lever 18 for bucket are frequently operated in increase or decrease. This means that larger the complicatedness indicating amounts ch1, ch2, the operating levers 17, 18 are frequently operated in increase or decrease so that the complicated boom operation and bucket operation are carried out.

In the complicatedness indicating amounts ch1, ch2 as described, for example, the number in which a primary derivative of the waveform a of the operating amount (a speed in change of the operating amount) changes in sign from positive to negative or negative to positive (the number of maximum points and minimum points of the waveform a) may be grasped as the complicatedness indicating amounts ch1, ch2. Alternatively, the waveform a of the operating amount may be subjected to Fourier conversion in frequency component so as to obtain power of a high frequency component in excess of a predetermined frequency, which may be grasped as the complicatedness indicating amounts ch1, ch2.

The high speed swing time grasping section 45 obtains a total of time at which the absolute value of the operating amount of the operating lever 21 exceeds a predetermined operating amount within a predetermined time from data of the operating amount for a part for a predetermined time of the swing operating lever 21, which is grasped as the high speed swing time (hereinafter referred to as reference symbol ch3).

The boom reversing operating time grasping section 46 obtains a total of time at which the operating amount of the operating lever 17 for boom exceeds a predetermined operating amount on the positive side of the operating direction (on the up-side of boom) within a predetermined time and the operating amounts of the operating lever 20 for arm and the operating lever 18 for bucket are less than a predetermined operating amount on the negative side of the operating direction (on the pull-in side of arm and bucket) from data of the operating amounts for a part for a predetermined time of the operating levers 17, 20, 18 for boom, arm and bucket, which is grasped as the boom reversing operating time (hereinafter referred to as reference symbol ch4). The boom reversing operating time ch4 thus obtained means a total time within a predetermined time in the state where the boom is driven on the up-side while the arm and bucket are driven on the pull-in side.

The bucket and arm stop time grasping section 47 obtains a total of time at which the absolute value of the operating lever 17 for boom exceeds a predetermined operating amount within a predetermined time and the absolute value of the operating amounts of the operating lever 20 for arm and the operating lever 18 for bucket is less than a predetermined operating amount, which is grasped as the bucket and arm stop time (hereinafter referred to as reference symbol ch5). The bucket and arm stop time ch5 thus obtained means a total time within the predetermined time in the state where only the boom is driven in the state where the bucket and arm are substantially stopped.

The boom operating average value grasping section 48, the arm operating average value grasping section 49 and the bucket operating average value grasping section 50 obtain an average value of the absolute value of the operating amounts of the operating levers 17, 20, 18 within a predetermined time from data of operating amounts for a part for a predetermined time of the operating levers 17, 20, 18 for boom, arm and bucket, which are grasped as the average value of the operating amount of boom, the average value of the operating amount of arm and the average value of the operating amount of bucket, respectively, (hereinafter referred to as reference symbols ch6, ch7, ch8).

The operating mode control section 42 comprises an absorbing horse power setting section 51 for setting plural kinds of operating modes (operating characteristics) described later of the hydraulic pumps 2, 3, according to the classifications of works discriminated by the classification of work discriminating section 41, a maximum discharge setting section 52, a discharge rate of change setting section 53, a response time constant setting section 54, a hydraulic pump control section 55 for controlling the hydraulic pumps 2, 3 through the first proportional solenoid valve 23 and the second proportional solenoid valve 24, an auto acceleration control section 56 (auto acceleration means) for performing the auto acceleration control described later of the engine according to the classifications of works discriminated by the classification of work discriminating section 41.

Figure 17:
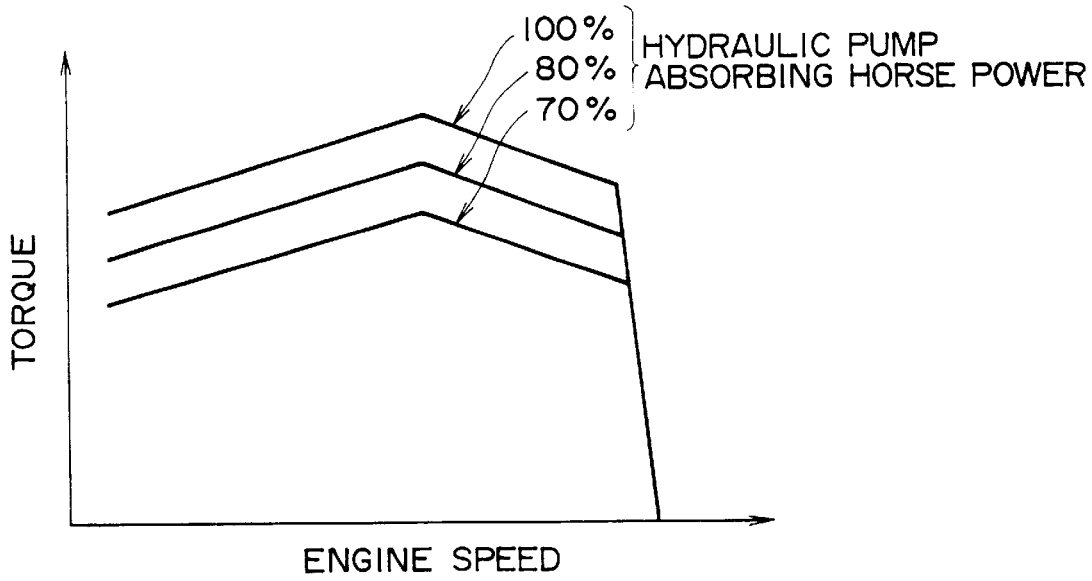
FIG. 17 is a diagram for explaining the control of engine speed of an engine according to the present invention.

The absorbing horse power setting section 51 sets, according to the classifications of works, a so-called hydraulic pump absorbing horse power, which is the rate at which output of the engine 1 is absorbed by the hydraulic pumps 2, 3. For example, as shown in FIG. 17, the hydraulic pump absorbing horse power is set to 100%, 80% and 70% according to the classifications of works. Here, the hydraulic pump absorbing horse power of 100% indicates the state where output torque of the engine 1 at each engine speed matches generation torque of the hydraulic pumps 2, 3 (this matches the product of discharge and discharge pressure of the hydraulic pumps 2, 3). In this state, the output of the engine 1 is converted into outputs of the hydraulic pumps 2, 3 for driving the actuators 4–9. Further, the hydraulic pump absorbing horse power of 80% or 70% indicates the state where generation torque of the hydraulic pumps 2, 3 in each engine speed assumes 80% or 70% of the output torque of the engine 1. In this state, 80% or 70% of the output of the engine 1 is converted into the output of the hydraulic pumps 2, 3 for driving the actuator 4–9.

The hydraulic pumps 2, 3 are operated in accordance with the set value of the hydraulic pump absorbing horse power by obtaining generation torque of the hydraulic pumps 2, 3 corresponding to the set value of the hydraulic pump absorbing horse power from the engine speed detected by the engine speed sensor 33 and a data table as shown in FIG. 17 and regulating the discharge of the hydraulic pumps 2, 3 so that the product of the discharge pressure of the hydraulic pumps 2, 3 (this relies upon the load of the actuators 4–9 and is detected by the pressure sensors 31, 32) and the discharge match the generation torque thus obtained.

Figure 18:
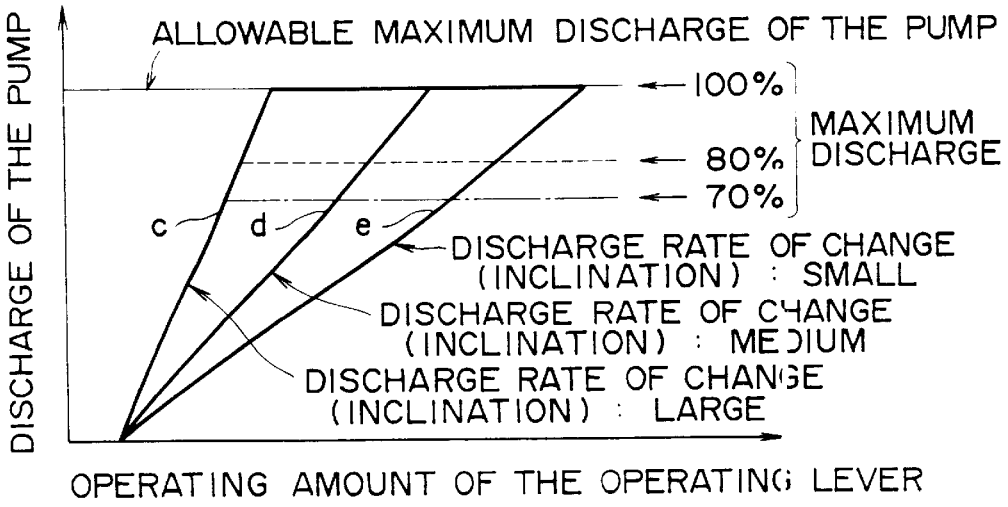
FIG. 18 is a diagram for explaining the control of a pump discharge according to the present invention.

The maximum discharge setting section 52 sets the maximum discharge (upper limit discharge of the hydraulic pumps 2, 3) of working fluid from the hydraulic pumps 2, 3 to the actuators 4–9 according to the classifications of works. For example, as shown in FIG. 18, the maximum discharge equal to the allowable maximum discharge of the hydraulic pumps 2, 3 is determined to 100%, and the maximum discharge is set to 100%, 80% and 70%. The larger the maximum discharge, the maximum operating speed of the actuators 4–9 by the operation of the operating levers 17 to 22 increases.

As shown in FIG. 18, the discharge rate of change setting section 53 sets the rate (inclinations of straight lines c, d and e in FIG. 5) of a change amount (a static change amount) of discharge of working fluid from the hydraulic pumps 2, 3 to the actuators 4–9 with respect to a change amount of the operating amounts of the operating levers 17–22 as a discharge rate of change according to the classifications of works. As shown, the discharge rate of change is set to three kinds, large, medium and small, for example. The larger the discharge rate of change, the larger a change in increase or decrease of the operating speed of the actuators 4–9 with respect to an increase or decrease of the operating amounts of he operating levers 17–22 becomes.

The response time constant setting section 54 sets, according to the classifications of works, the response time constant for defining a change speed of the operating speed of the actuators 4–9 with respect to a change speed of the operating amounts of the operating levers 17–22. The response time constant is set to 0s, 0.2s, 0.3s, and 0.5s, for example. The smaller the response time constant, followability (responsibility) of the operating speed of the actuators 4–9 with respect to the change in the operating amounts of the operating levers 17–22.

The work in accordance with the response time constant set is carried out, for example, when the operating amounts of the operating levers 17–22 are changed, by delaying the energizing timing relative to the proportional solenoid valves 23, 24 for producing the change of discharge of the hydraulic pumps 2, 3 according thereto through the time of the response time constant.

The hydraulic pump control section 55 determines the energizing mount to the first and second proportional solenoid valves 23, 24 so that working fluid of flow rate according to momentary operating amounts of the operating levers 17–22 is supplied to the actuators 4–9 in accordance with the hydraulic pump absorbing horse power, the maximum discharge, the discharge rate of change and the response time constant set according to the classifications of works by the setting sections 51–54 as previously mentioned, to energize the proportional solenoid valves 23, 24 thereby controlling the discharge of the hydraulic pumps 2, 3.

The auto acceleration control section 56 fundamentally controls the engine speed to a predetermined constant speed after passage of a predetermined time after all the operating amounts of the operating levers 17–22 detected by the operating amount sensors 25–30 have assumed "0" (when all the operating levers 17–22 are operated to the neutral position), and after this, when any of the operating levers 17–22 is operated, the engine speed is returned to its original engine speed (this control will be hereinafter referred to as the auto acceleration control). In this case, the auto acceleration control section 56 makes the auto acceleration control effective (the auto acceleration control is carried out) or makes the auto acceleration control invalid (the auto acceleration control is not carried out) depending on the classifications of works discriminated by the classification of work discriminating section 41.

The second classification of work discriminating method will be described hereinafter. In this case, the classification of work discriminating section 41 in FIG. 2 is replaced by a classification of work discriminating section 41' in FIG. 3.

The classification of work discriminating section 41' comprises, for the purpose of discriminating classifications of works, plural kinds (8 kinds in the present embodiment) of feature amounts from data of operating amounts for a part for a predetermined time of the operating levers 17 to 21 retained by the data retaining section 40, i.e. a boom operation complicatedness grasping section 43 for grasping, a bucket operation complicatedness grasping section 44, a high speed swing time grasping section 45, a boom reversing operating time grasping section 46, a bucket and arm stop time grasping section 47, a boom operation average value grasping section 48, an arm operation average value grasping section 49 and a bucket operation average value grasping section 50 as feature amount calculation means. The classification of work discriminating section 41' further comprises, in addition to the aforementioned grasping sections 43–50, a memory 57 for storing and retaining in advance a plurality of membership function for fuzzy inference, a fitness calculation section 58 (fitness calculation means) for obtaining a fitness of feature amount grasped by the aforementioned grasping sections 43–50 to the classifications of works during work using the membership functions stored and retained by the memory 57, and a comparison section 59 for comparing specific plural feature amounts out of the feature amounts grasped by the grasping sections 43–50 with a predetermined value.

In the present embodiment, the complicatedness indicating amount of boom operation, the complicatedness indicating amount of bucket operation, the high speed swing time, the boom reversing operating time, the bucket and arm stop time, the boom operating amount average value, the arm operating amount average value and the bucket operating amount average value are feature amounts indicating the operating state of the hydraulic excavator grasped by the grasping sections 43–50.

As illustrated in FIGS. 6 to 13, the membership functions stored and retained in the memory 57 indicate a predetermined relation between values of eight kinds of feature amounts such as the complicatedness indicating amount of boom operation and the fitness of the feature amounts relative to the classifications of works. The membership functions corresponding to the feature amounts are stored and retained in the memory 57. That is, the membership functions are set every set of the classifications of works and the feature amounts. In this case, the membership functions corresponding to each set of the classifications of works and the feature amounts are fundamentally set so that the fitness corresponding to the value of the feature amount is the maximum value ("1" in the present embodiment), in a range of a value normally taken by each feature amount during actual work for classifications of works, and the fitness gradually decreases as the value of the feature amount deviates from the aforementioned range.

More specifically, the membership functions corresponding to eight kinds of feature amounts as described above are set as shown by solid lines and broken lines in FIGS. 6 to 13 in connection with, for example, the simple digging work and the finishing with swing work.

Figure 6:
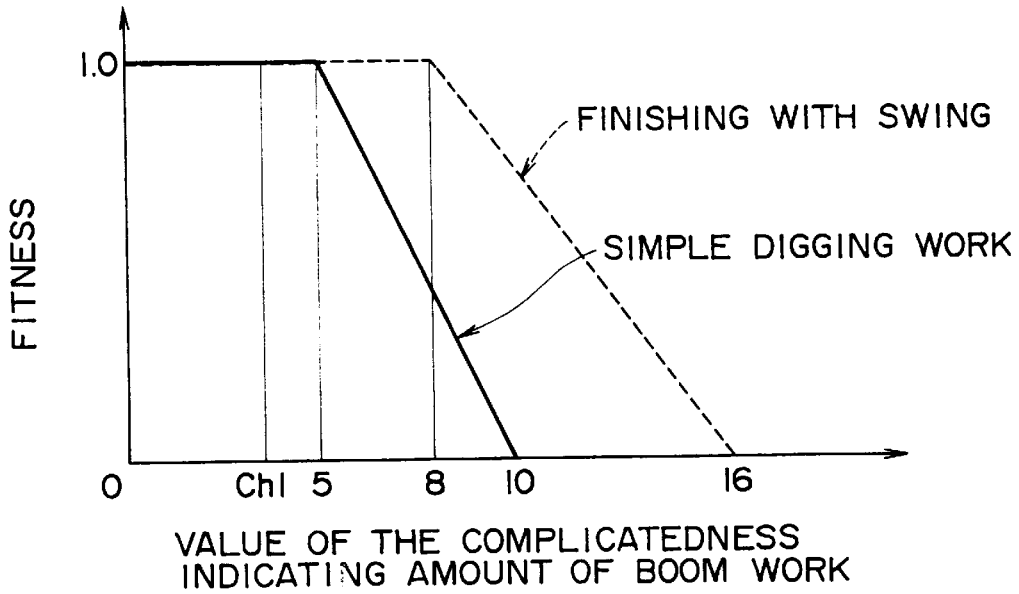
FIG. 6 is a diagram for explaining the work of the second classification of work discriminating method.
Figure 7:
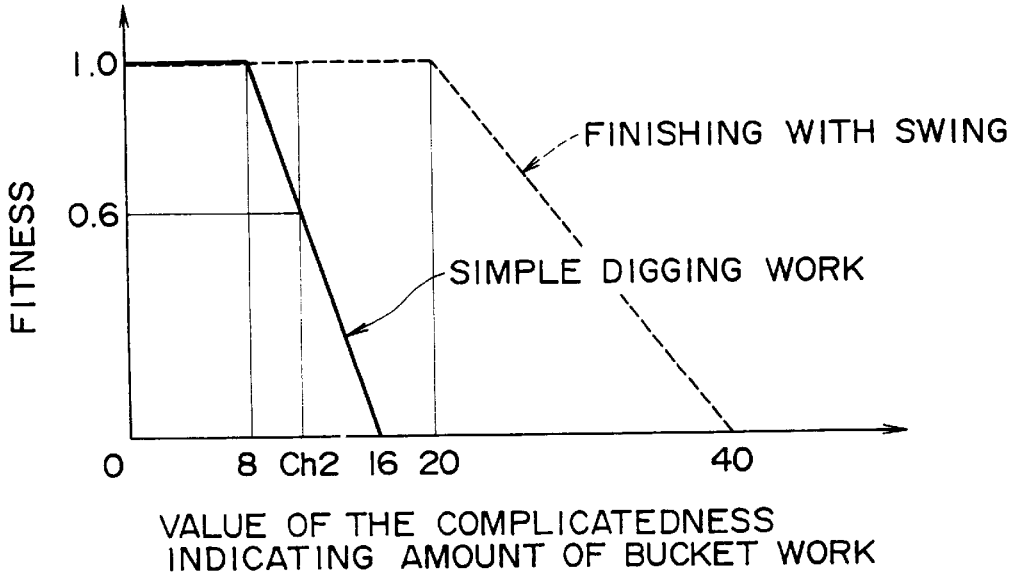
FIG. 7 is a diagram for explaining the work of the second classification of work discriminating method.

In this case, in the simple digging work indicating the membership function by solid lines in FIGS. 6 to 13, normally, the operating lever 17 for boom and the operating lever 18 for bucket are less operated in increase or decrease in a short period of time. Therefore, as shown in FIGS. 6 and 7, the membership function are set so that the fitness is "1" on the maximum in the range in which the value of the complicatedness indicating amount of boom work and the complicatedness indicating amount of bucket work is relatively low including "0".

Figure 8:
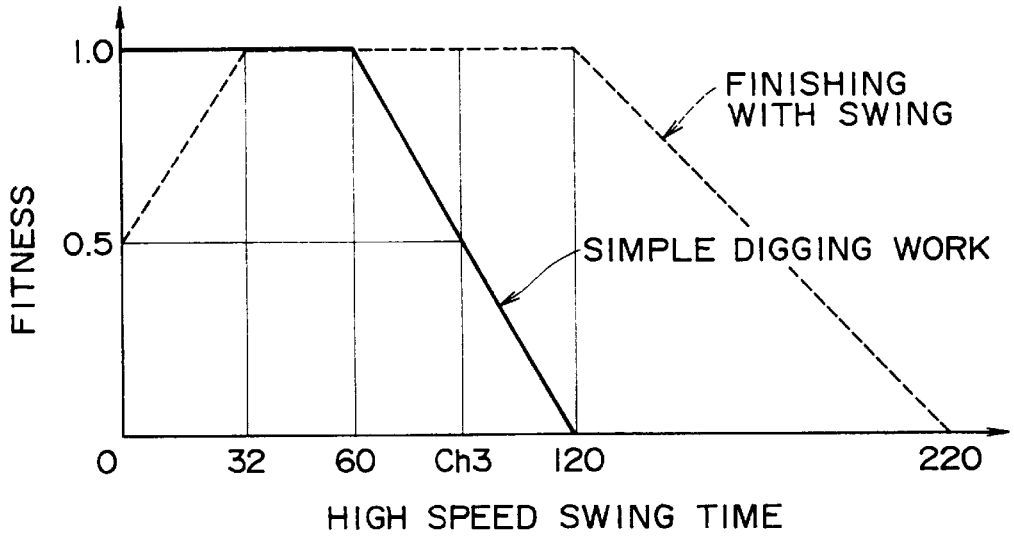
FIG. 8 is a diagram for explaining the work of the second classification of work discriminating method.
Figure 9:
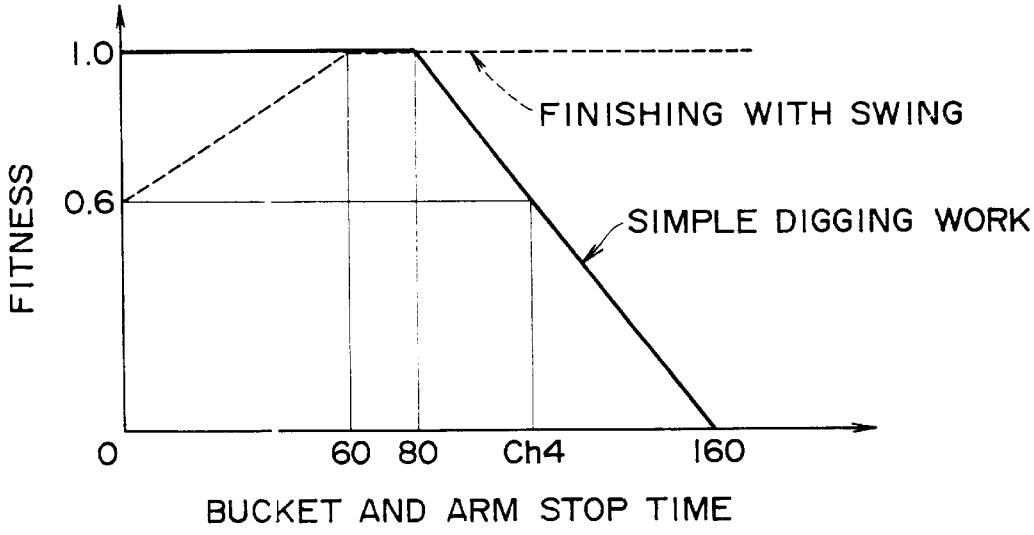
FIG. 9 is a diagram for explaining the work of the second classification of work discriminating method.
Figure 10:
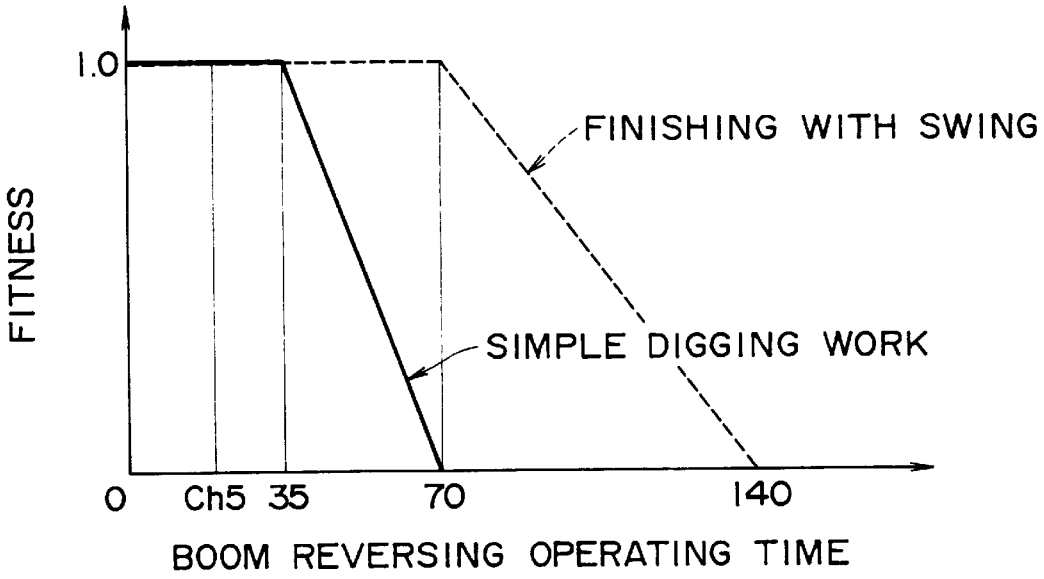
FIG. 10 is a diagram for explaining the work of the second classification of work discriminating method.

In the simple digging work, normally, the frequency of the work of high swing, the work for driving only the boom in the state where the bucket and arm substantially stop, and the state where the bucket and arm are driven on the pull-in side while driving the boom on the up-side is less. Therefore, as shown in FIGS. 8 to 10, the membership function are set so that the fitness is "1" on the maximum in the range in which the value of the high speed swing time, the bucket and arm stop time and the boom reversing operating time is relatively low including "0". The time indicated on the axis of abscissas in FIGS. 8 to 10 represents on a scale with a predetermined unit time being "1".

Figure 11:
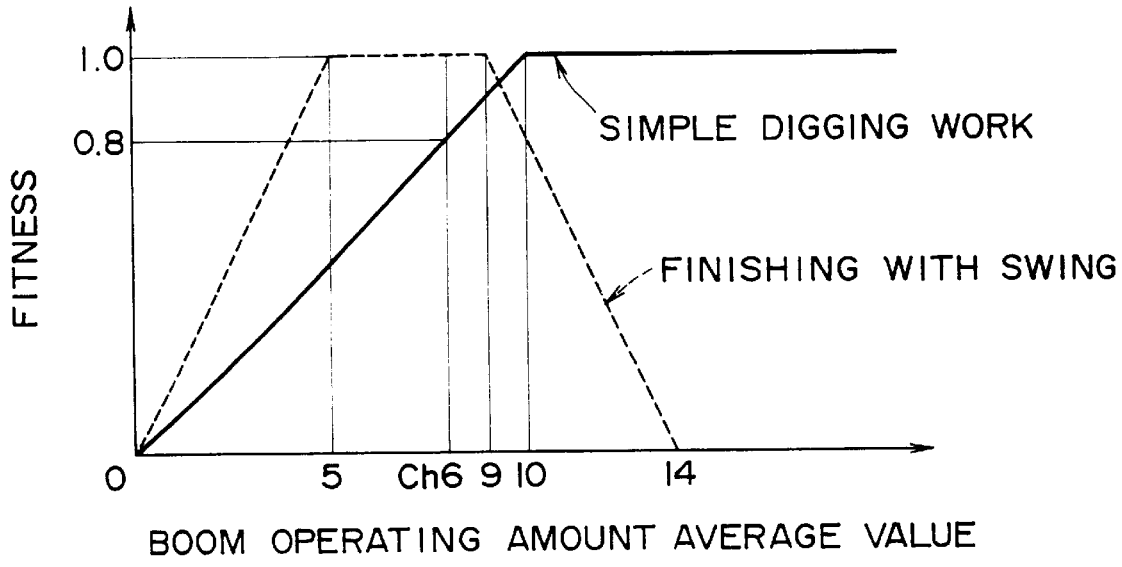
FIG. 11 is a diagram for explaining the work of the second classification of work discriminating method.
Figure 12:
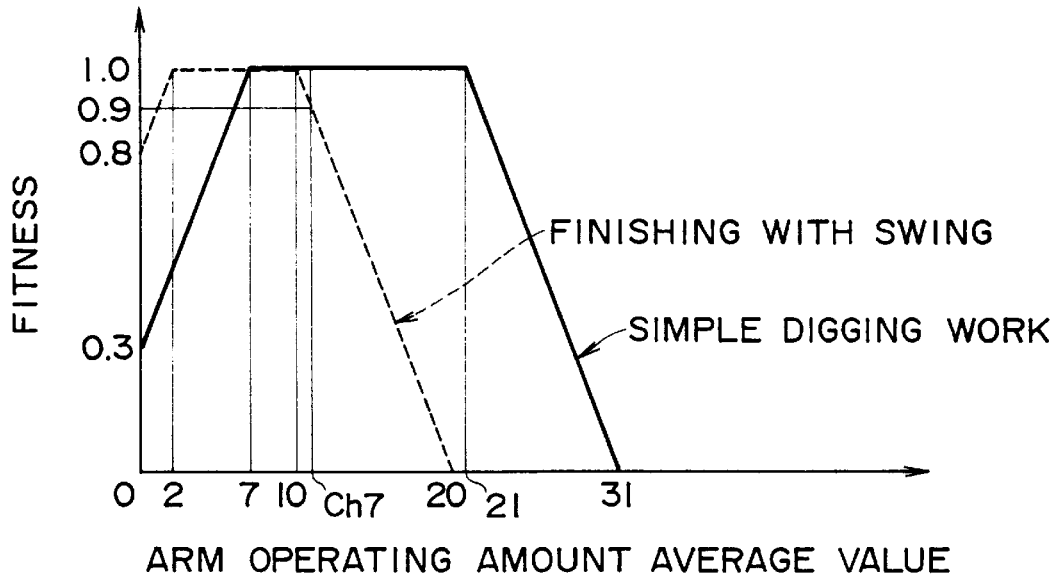
FIG. 12 is a diagram for explaining the work of the second classification of work discriminating method.
Figure 13:
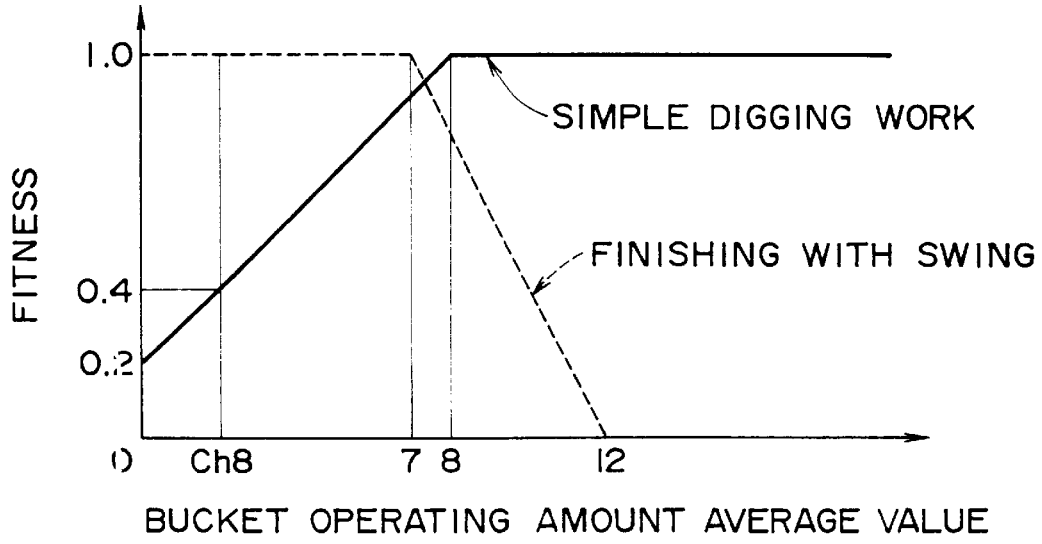
FIG. 13 is a diagram for explaining the work of the second classification of work discriminating method.

In the simple digging work, normally, the operating lever 17 for boom and the operating lever 18 for bucket are often operated with a relatively large operating amount. Therefore, as shown in FIGS. 11 to 13, the membership functions are set so that the fitness is "1" on the maximum in the range in which the value of the boom operating amount average value and the bucket operating amount average value is relatively high in excess of a certain value. Since the operating lever 20 for arm is often operated with a medium operating amount, the membership functions are set so that the fitness is "1" on the maximum in the range in which the value of the arm operating amount average value is about medium, as shown in FIG. 12.

On the other hand, in the finishing with swing work showing the membership functions by broken lines in FIGS. 6 to 13, normally, the operating lever 17 for boom and the operating lever 18 for bucket are less extremely frequently operated in increase or decrease but the chance of the increase or decrease work is more than that of the simple digging work. Therefore, as shown in FIGS. 4 and 5, the membership function are set so that the fitness is "1" on the maximum in the range in which the value of the complicatedness indicating amount of boom operation and the complicatedness indicating amount of bucket operation is relatively low including "0" and in the range in which is wider than the case of the simple digging work.

In the finishing with swing work, the state for high speed swing is normally higher in frequency than the case of the simple digging work. Therefore, the membership functions are set so that the fitness is "1" on the maximum in the range in which the value of the high speed swing time is generally medium which is larger than that of the case of the simple digging work, as shown in FIG. 8.

Further, in the finishing with swing work, normally, only the boom is relatively often driven in the state where the bucket and arm substantially stop, contrary to the case of the simple digging work. Therefore, the membership function are set so that the fitness is "1" on the maximum in the range in which the value of the bucket stop time is relatively larger, as shown in FIG. 9.

Further, in the finishing with swing work, normally, the frequency of the state where the bucket and arm are driven on the pull-in side while driving the boom on the up-side is not so high but its frequency is higher than the case of the simple digging work. Therefore, as shown in FIG. 10, the membership functions are set so that the fitness is "1" on the maximum in the range in which the value of the boom reversing operating time is relatively low including "0" and in the range in which is wider than the case of the simple digging work.

Further, in the finishing with swing work, the operating lever 20 for arm and the operating lever 18 for bucket are often operated with a relatively small operating amount. Therefore, the membership functions are set so that the fitness is "1" on the maximum in the range in which the arm operating amount average value and the bucket operating amount average value are relatively low including "0", as shown in FIGS. 12 and 13. Since the operating lever 17 for boom is often operated with a medium operating amount, the membership functions are set so that the fitness is "1" on the maximum in the range in which the value of the boom operating amount average value is medium, as shown in FIG. 11.

The setting of the membership functions with respect to the feature amounts every classification of work is similarly applied to classifications of works other than the simple digging work and the finishing with swing work. The membership functions are set so that the fitness corresponding to the value of the feature amount is "1" on the maximum in the range of a value normally taken by the feature amounts in the actual work for classifications of works. The membership functions are set so that the fitness gradually lowers as shown in FIGS. 6 to 13 as the value of the feature amount with respect to the classification of work deviates from the range of normal value. In the case where the range of normal value of the feature amount with respect to the classifications of works extends over the entire range of the feature amount, the membership functions are set so that the fitness is "1" on the maximum over the entire range of the feature amount.

The fitness calculation section 58 obtains the fitness with respect to the classifications of works of the feature amounts every classification of work using the membership functions set as described above from the values of the feature amounts actually grasped by the grasping sections 43–50 during work. The fitness calculation section 58 further obtains the fitness of minimum value out of fitnesses obtained with respect to the feature amounts every classifications of works as a synthetic fitness of the feature amounts with respect to the classifications of works (hereinafter referred to as a synthetic fitness).

More specifically, referring to FIGS. 6 to 13, for example, let ch1, ch2, ch3, ch4, ch5, ch6, ch7 and ch8 be values of eight kinds of feature amounts described above grasped by the grasping sections 43–50 (the complicatedness indicating amount of boom operation, the complicatedness indicating amount of bucket operation, the high speed swing time, the boom reversing operating time, the bucket and arm stop time, the boom operating amount average value, the arm operating amount average value and the bucket operating amount average value), then, the fitnesses with respect to the simple digging work of the values ch1 to ch8 of the feature amounts are, 1, 06, 0.5, 0.6, 1, 0.8, 1, and 0.4, respectively, and at this time, the synthetic fitness with respect to the simple digging work is the minimum value "0.4" out of values of the fitness every feature amount. Similarly, the fitnesses with respect to the finishing with swing work of the values ch1 to ch8 of the feature amounts are 1, 1, 1, 1, 1, 1, 0.9 and 1, respectively, and at this time, the synthetic fitness with respect to the finishing with swing work is the minimum value "0.9" out of values of the fitness every feature amount.

With respect to the synthetic fitness thus obtained, the larger the value thereof, the fitness property of the feature amount to the classification of work corresponding to the synthetic fitness is high, which means that the probability at which the work for classification of work is carried out is high. Accordingly, in case of the above, the possibility at which the finishing with swing work whose synthetic fitness is 0.9 is higher than that at which the simple digging work whose synthetic fitness is 0.4 is carried out. In this case, if the synthetic fitness corresponding to another classifications of works is smaller than 0.9, the possibility at which among all the classifications of works, the finishing with swing work is carried out is highest. The comparison section 59 compares the feature amounts grasped by the bucket operation complicatedness grasping section 44, the high speed swing time grasping section 45 and the bucket and arm stop time grasping section 47 out of the grasping sections 43–50 with a predetermined value determined in advance every feature amount. This comparison is carried out to discriminate the scattering work and the compacting work out of the classifications of works as will be described later.

The classification of work discriminating section 41 provided with a configuration as described above discriminates the classification of work presently being carried out as described above by the hydraulic excavator on the basis of the synthetic fitness every classification of work obtained by the fitness calculation section 58 or the result of comparison obtained by the comparison section 59.

The operation of the present hydraulic excavator control apparatus will be described hereinafter.

When the work by the hydraulic excavator starts, detected data of the operating amount sensors 25–30 are retained in the data retaining section 40 through a part for a predetermined time, which is updated every 5 seconds, for example. The classification of work discriminating section 41 obtains, on the basis of data retained in the data retaining section 40, the complicatedness indicating amount of boom operation ch1, the complicatedness indicating amount of bucket operation ch2, the high speed swing time ch3, the boom reversing operating time ch4, the bucket and arm stop time ch5, the boom operating amount average value ch6, the arm operating amount average value ch7 and the bucket operating amount average value ch8 by the grasping sections 43–50, and discriminates the classification of work being presently performed as shown in a flowchart of FIG. 14 from the feature amounts thereof.

More specifically, the classification of work discriminating section 41 first compares the complicatedness indicating amount of bucket operation ch2 with a predetermined value Th1 determined in advance corresponding thereto (STEP 1). If ch2≧Th1, judgment is made in which the classification of work being done is the scattering work.

The scattering work repeats at high speeds the work in which earth is scooped in the bucket by the simultaneous operation of bucket, arm and boom, which is then scattered by the work of bucket. In such a work as described, particularly, the operating amount of the operating lever 18 for bucket frequently varies in increase or decrease. Therefore, the complicatedness indicating amount of bucket operation ch2 is large in value as compared with other works. Accordingly, if the predetermined value Th1 is properly set, the condition of STEP 1 is established in the scattering work whereby judgment can be made in which the scattering work is carried out.

If the condition of STEP 1 is not established, the classification of work discriminating section 41 then compares the complicatedness indicating amount of boom work ch1, the high speed swing time ch3 and the bucket and arm stop time ch5 with predetermined values Th2, Th3 and Th4 determined in advance, respectively (STEP 2). If ch1≧Th2, ch3≦Th3 and ch5≧Th4, judgment is made in which the classification of work is the compacting work.

The compacting work is the work in which the bucket is thrown against the ground to harden the ground by repeatedly moving the boom up and down. In such a work as described above, particularly, the operating amount of the operating lever 17 for boom frequently varies in increase or decrease, and the high speed swing work is hardly carried out. Further, the time at which the bucket and arm stops when the boom moves up and down is relatively long. For this reason, the complicatedness indicating amount of boom operation ch1 is large in value as compared with other works, the high speed swing time ch3 is relatively short, and the bucket and arm stop time ch5 is relatively long. Accordingly, if the predetermined values Th2, Th3 and Th4 are properly set, the condition of STEP 2 is established in the compacting work whereby judgment can be made in which the compacting work is carried out.

If the condition of STEP 2 is not established, the classification of work discriminating section 41 then compares the complicatedness indicating amount of bucket operation ch2, the bucket and arm stop time ch5, the boom reversing operating time ch4, and the total value (ch7+ch8) of the arm operating amount average value ch7 and the bucket operating amount average value ch8 with predetermined values Th5, Th6, Th7 and Th8 determined in advance, respectively (STEP 3). If ch2≦Th5, ch5≦Th6, ch4≧Th7, and (ch7+ch8)≧Th8, judgment is made in which the classification of work is the slope finishing work.

The slope finishing work is the work in which the bucket is placed along the inclined plane, by the simultaneous operation of the bucket, arm and boom, in which state the arm and the boom are operated to shave the inclined plane. In such a work, particularly, the operating lever 18 for bucket is not moved so frequently, less work is done in which the boom is moved up and down in the state where the bucket and the arm substantially stop, the time at which the bucket and the arm are operated on the pull-in side while moving up the boom is long, and the operating amount of the operating lever 18 for bucket or the operating lever 20 for arm is relatively large on the average. Therefore, the complicatedness indicating amount of bucket operation ch2 is small as compared with other works, the bucket and arm stop time ch5 is relatively short, and the boom reversing operating time ch4, and the total value (ch7+ch8) of the arm operating amount average value ch7 and the bucket operating amount average value ch8 are relatively large. Accordingly, if the predetermined values Th6, Th7 and Th8 are properly set, the condition of STEP 3 is established in the slope finishing work whereby judgment can be made in which the slope finishing work is carried out.

If the condition of STEP 3 is not established, the classification of work discriminating section 41 then compares the complicatedness indicating amount of boom operation ch1, the complicatedness indicating amount of bucket operation ch2, the high speed swing time ch3, the bucket and arm stop time ch5, and the total value (ch7+ch8) of the arm operating amount average value ch7 and the bucket operating amount average value ch8 with predetermined values Th9, Th10, Th11, Th12 and Th13 determined in advance (STEP 4). If ch1≦Th9, ch2≦Th10, ch3≦Th11, ch5≦Th12 and (ch7+ch8)≦Th13, judgment is made in which the classification of work is the crane work.

The crane work is the work in which an article to be transported is hung from the edge of the bucket through a rope or the like to move the article. In such a work as described, particularly, less state is present in which the operating lever 17 for boom and the operating lever 18 for bucket are frequently moved and the swing work is carried out at high speeds, and the work for vertically moving the boom in the state where the bucket and the arm substantially stop is relatively less. Further, the operating amount of the operating lever 18 for bucket and the operating lever 20 for arm is relatively small on the average. Therefore, the complicatedness indicating amount of boom operation ch1 and the complicatedness indicating amount of bucket operation ch2 are small as compared with other works, the high speed swing time ch3 and the bucket and arm stop time ch5 are relatively short, and the total value (ch7+ch8) of the arm operating amount average value ch7 and the bucket operating amount average value ch8 are relatively small. Accordingly, if the predetermined values Th9, Th10, Th11, Th12 and Th13 are properly set, the condition of STEP 4 is established in the crane work whereby judgment can be made in which the crane work is carried out.

If the condition of STEP 4 is not established, the classification of work discriminating section 41 then compares the speed swing time ch3, the bucket and arm stop time ch5, and the total value (ch7+ch8) of the arm operating amount average value ch7 and the bucket operating amount average value ch8 with predetermined values Th14, Th15, and Th16 determined in advance (STEP 5). If ch3≧Th14, ch5≦Th15, and (ch7+ch8)≧Th16, judgment is made in which the classification of work being done is the digging with swing.

The digging with swing is a work in which in case of digging a ditch in a longitudinal direction of a hydraulic excavator at a position sideways of the vehicle, a bucket is pushed to the ground and pulled while performing the swing work to effect excavation. In such a work as described, particularly, the high speed swing work is frequently carried out, the work for vertically moving the boom in the state where the bucket and the arm substantially stop is relatively less, and the operating amount of the operating lever 18 for bucket and the operating lever 20 for arm is relatively large on the average. Therefore, the high speed swing time ch3 is long as compared with other works, the bucket and arm stop time ch5 is relatively short, and the total value (ch7+ch8) of the arm operating amount average value ch7 and the bucket operating amount average value ch8 is relatively large. Accordingly, if the predetermined values Th14, Th15 and Th16 are properly set, the condition of STEP 5 is established in the digging with swing whereby judgment can be made in which the digging with swing is carried out.

If the condition of STEP 5 is not established, the classification of work discriminating section 41 then compares the complicatedness indicating amount of boom operation ch1, the complicatedness indicating amount of bucket operation ch2, the high speed swing time ch3, and the boom reversing operating time ch4 with predetermined values Th17, Th18, Th19 and Th20 determined in advance (STEP 6). If ch1≦Th17, ch2≦Th18, ch3 <Th19, and ch4≦Th20, judgment is made in which the classification of work being done is the loading work. The loading work is a work in which when a hydraulic excavator is transported, the hydraulic excavator is loaded on a trailer or the like. In such a work as described, particularly, there hardly occurs that the operating lever 17 for boom and the operating lever 18 for bucket are frequently moved and the swing work is carried out at high speeds, and there hardly occurs that the bucket and the arm are operated on the pull-in side while vertically moving the boom. Therefore, the complicatedness indicating amount of boom operation ch1, the complicatedness indicating amount of bucket operation ch2, the high speed swing time ch3, and the boom reversing operating time ch4 are relatively short. Accordingly, if the predetermined values Th17, Th18, Th19 and Th20 are properly set, the condition of STEP 6 is established in the loading work whereby judgment can be made in which the loading work is carried out.

If the condition of STEP 6 is not established, the classification of work discriminating section 41 then compares the high speed swing time ch3, the bucket and arm stop time ch5, and the total value (ch6+ch7) of the boom operating amount average value ch6 and the arm operating amount average value ch7 with predetermined values Th21, Th22, and Th23 determined in advance (STEP 7). If ch3≧Th21, ch5≦Th21, and (ch6+ch7)≧Th23, judgment is made in which the classification of work being done is the finishing with swing work.

The finishing with swing work is a work in which a bucket is brought into contact with the ground, in which state the swing work is performed to effect ground-leveling. In such a work as described, particularly, there involves many high speed swing work and work for vertically moving the boom in the state where the bucket and the arm substantially stop, and the operating amount of the operating lever 17 for boom and the operating lever 20 for arm are relatively small on the average. Therefore, the high speed swing time ch3 and the bucket and arm stop time ch5 are relatively long and the total value (ch6+ch7) of the boom operating amount average value ch6 and the arm operating amount average value ch7 is relatively small. Accordingly, if the predetermined values Th21, Th22, and Th23 are properly set, the condition of STEP 7 is established in the finishing with swing work whereby judgment can be made in which the finishing with swing work is carried out.

If the condition of STEP 7 is not established, the classification of work discriminating section 41 then compares the total value (ch6+ch7) of the boom operating amount average value ch6 and the arm operating amount average value ch7 with predetermined value Th24 determined in advance (STEP 8). If (ch6+ch7)≧Th24, judgment is made in which the classification of work being done is the digging works (the simple excavation, ditch excavation and horizontal excavation) other than the pressing and digging work.

These digging works are fundamentally a work in which a bucket is pushed to the ground and pulled this side at a position ahead of a hydraulic excavator. In such a work as described, the operating amount of the operating lever 17 for boom and the operating lever 20 for arm is relatively large on the average, and the total value (ch6+ch7) of the boom operating amount average value ch6 and the arm operating amount average value ch7 is relatively large. Accordingly, if the predetermined value Th24 is properly set, the condition of STEP 8 is established whereby judgment can be made in which the digging works other than the digging with swing are carried out.

If the condition of STEP 8 is not established, the classification of work discriminating section 41 disables discrimination of the classification of work.

When one of or a combination of the complicatedness indicating amount of boom work ch1, the complicatedness indicating amount of bucket work ch2, the high speed swing time ch3, the boom reversing operating time ch4, the bucket and arm stop time ch5, the arm operating amount average value ch7 and the bucket operating amount average value ch8 is (are) compared with a predetermined value, it is possible to discriminate many kinds of classifications of works with high accuracy.

The aforementioned discrimination of classifications of works is carried out every time data of the data retaining section 40 is updated.

Figure 15:
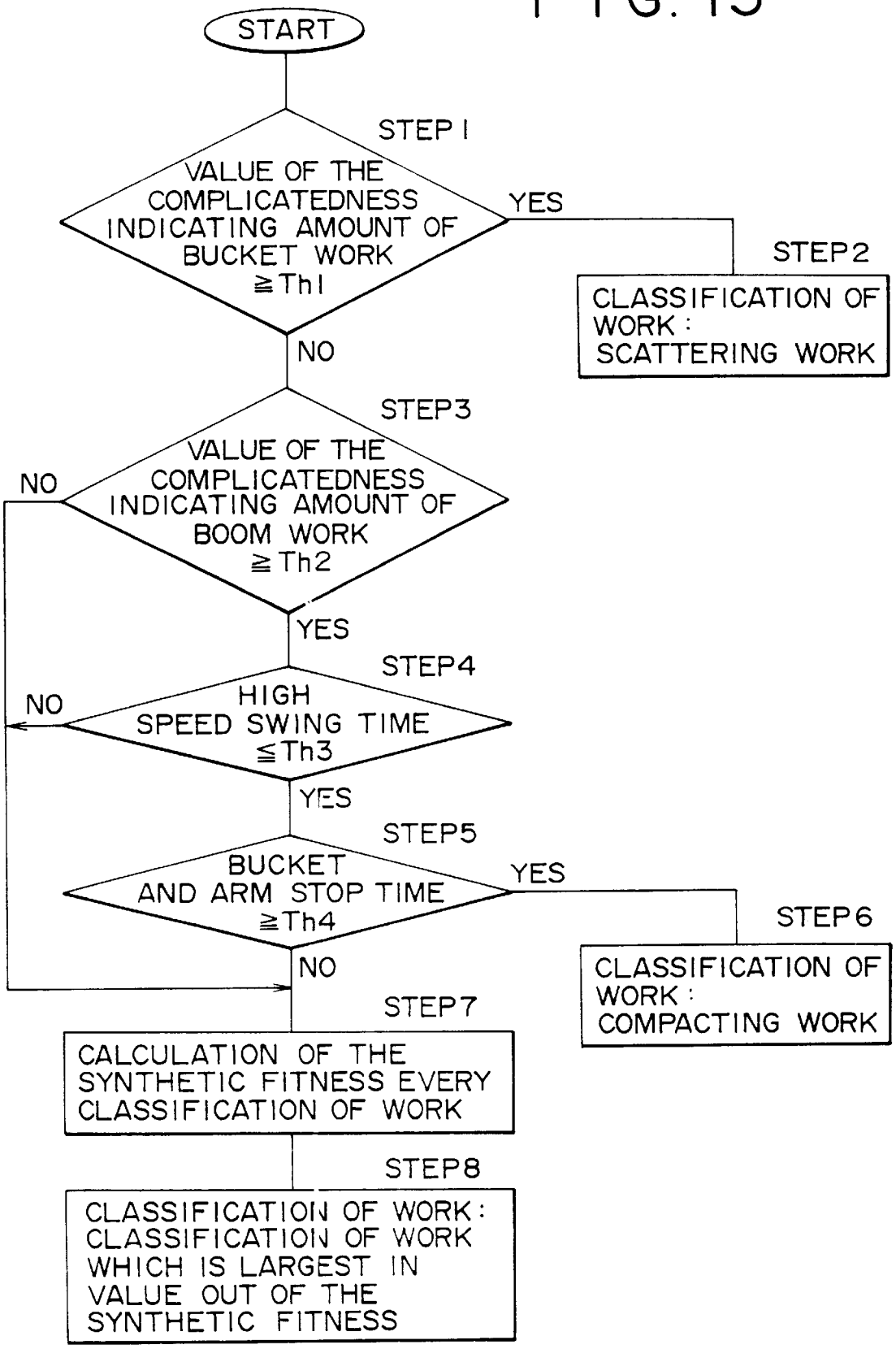
FIG. 15 is a flowchart for explaining the work of a first embodiment of the second classification of work discriminating method.
Figure 16A:
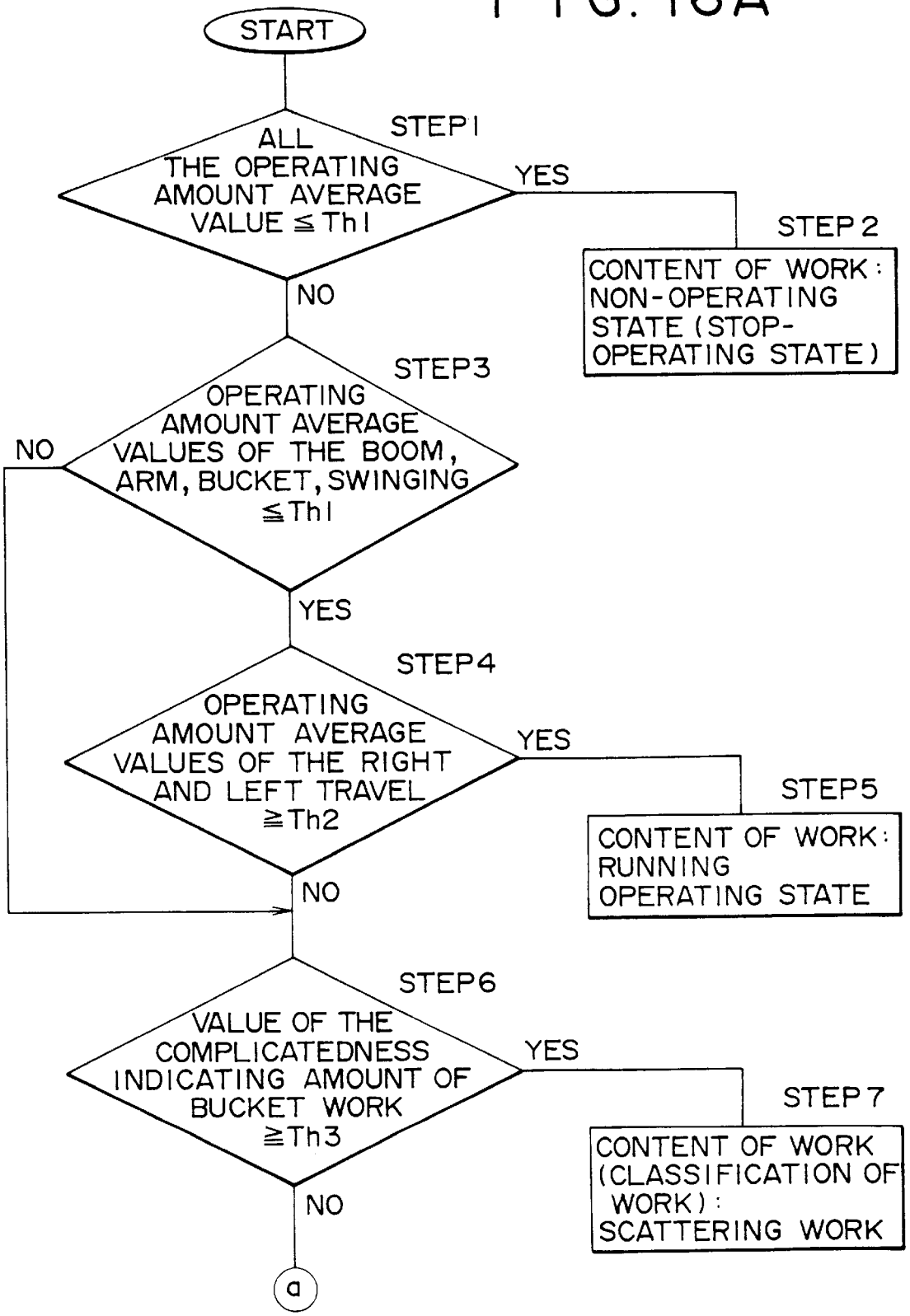
FIG. 16 is a flowchart for explaining the work of a second embodiment of the second classification of work discriminating method.
Figures 16, 16B:
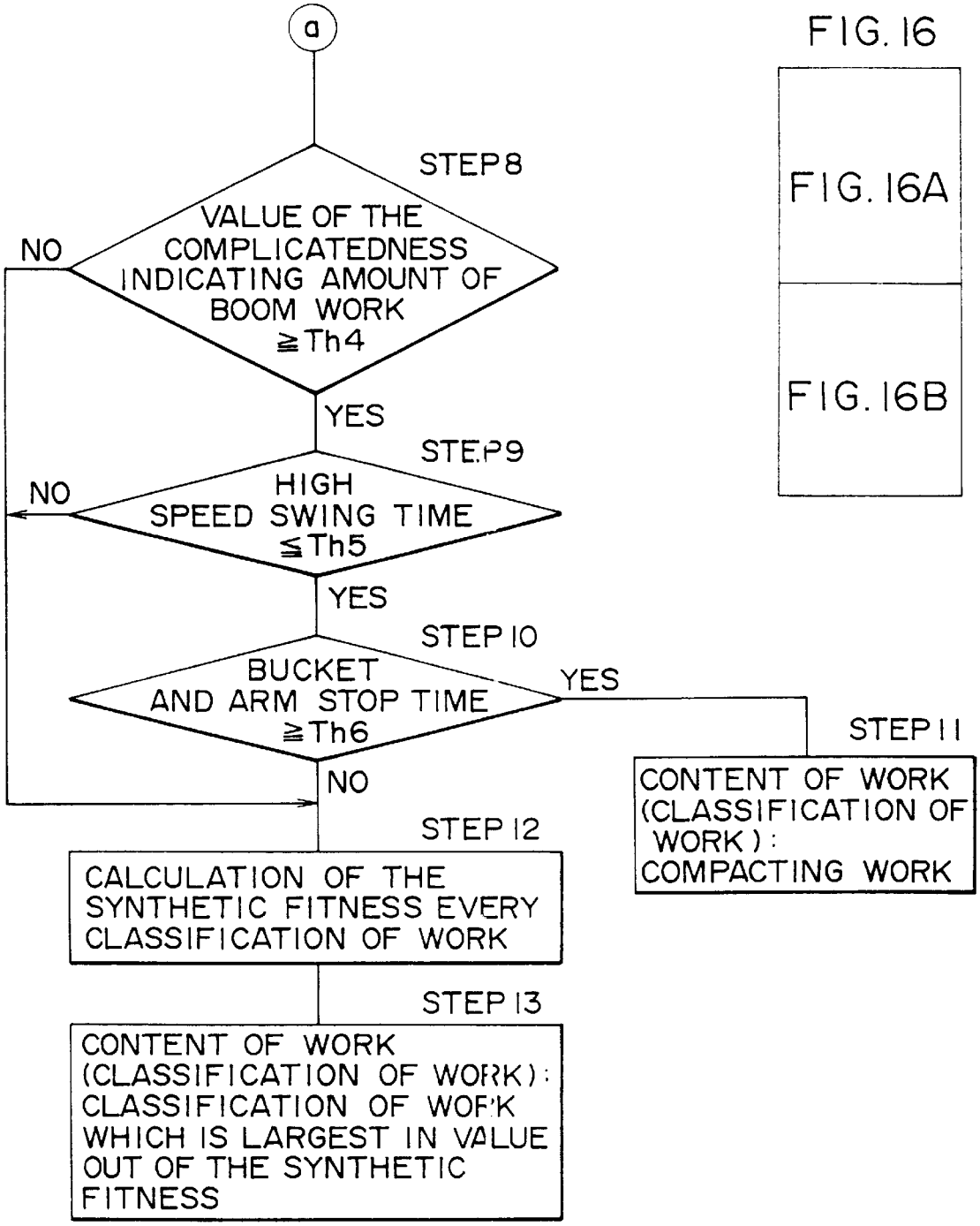

The work in the case where the second classification of work discriminating method is used will be described hereinafter referring to a flowchart of FIG. 15.

That is, in the classification of work discriminating section 41, the comparison section 59 compares the complicatedness indicating amount of bucket operation grasped by the grasping section 44 with a predetermined value Th1 determined in advance corresponding thereto (STEP 1). If the result of comparison is the complicatedness indicating amount of bucket operation≧Th1, judgment is made in which the classification of work being done is the scattering work (STEP 2).

The scattering work repeats at high speeds the work in which earth is scooped in the bucket, which is then scattered by the operation of bucket. In such a work as described, particularly, the operating amount of the operating lever 18 for bucket frequently varies in increase or decrease. Further, the motion of the operating lever 18 for bucket as described is conspicuous in the scattering work without being much affected by operator's taste or operating environment. Therefore, the complicatedness indicating amount of bucket operation is conspicuously large in value as compared with other works. Accordingly, if the predetermined value Th1 is properly set, the condition of STEP 1 is established in the scattering work whereby judgment can be made in which the scattering work is carried out.

If the condition of STEP 1 is not established, in the classification of work discriminating section 41, the comparison section 53 compares the complicatedness indicating amount of boom operation, the high speed swing time and the bucket and arm stop time grasped by the grasping sections 43, 45 and 47, respectively, with predetermined values Th2, Th3 and Th4 determined in advance, respectively (STEPS 3–5). If the results of comparison are that the complicatedness indicating amount of boom operation≧Th2, the high speed swing time≦Th3 and the bucket and arm stop time≧Th4, judgment is made in which the classification of work is the compacting work (STEP 6). The compacting work is the work in which the bucket is thrown against the ground to harden the ground by repeatedly moving the boom up and down. In such a work as described above, particularly, the operating amount of the operating lever 17 for boom frequently varies in increase or decrease, and the time at which the bucket and arm stops when the boom moves up and down is relatively long. The motion of the operating lever 17 for boom, the operating lever 20 for arm and the operating lever 18 for bucket as described is conspicuous in the scattering work without being much affected by operator's taste or operating environment. For this reason, the complicatedness indicating amount of boom operation is large in value as compared with other works, the high speed swing time is relatively short, and the bucket and arm stop time is relatively long. Accordingly, if the predetermined values Th2, Th3 and Th4 are properly set, the conditions of STEPS 3–5 are established in the compacting work whereby judgment can be made in which the compacting work is carried out.

If any of the condition of STEPS 3–5 is not established, in the classification of work discriminating section 41, the fitness every classification of work is obtained, on the basis of the membership functions stored and retained in the memory 57 with respect to the feature amounts grasped by the grasping sections 43–50 by the fitness calculation section 58, and further, the synthetic fitness in which the above fitnesses are synthesized is obtained every classification of work (STEP 7).

The classification of work discriminating section 41' judges that the classification of work corresponding to the synthetic fitness which is largest in value out of the synthetic fitness every classification of work is judged as the classification of work presently being done (STEP 8). For example, if the synthetic fitness corresponding to the finishing with swing as illustrated above is "0.9" (in this case, all the fitnesses every feature amount with respect to the finishing with swing are not smaller than "0.9") and the synthetic fitness corresponding to other classifications of works is not larger than "0.9" (including "0"), judgment is made in which the classification of work presently being done is the finishing with swing work. Thereby, it is judged that the classification of work to which feature amount is most adapted is the classification of work presently being done.

In STEP 8, in the case where there are a plurality of classifications of works corresponding to the synthetic fitness which is largest in value out of the synthetic fitness every classification of work, for example, in the case where with respect to the simple digging work and the horizontal digging work, their synthetic fitness is "1", the classification of operation discriminating section 41' disables discrimination of classification of work.

As described above, the fitness with respect to the classification of work of the feature amount is obtained using the membership function to thereby discriminate the classification of work whereby in the discrimination, the operating mode of the operating levers 17–22 in the classification of work or the irregularity in value of the feature amount is incorporated, and the classifications of works can be discriminated with high accuracy. In the case where the classification of work is discriminated using the fitness, the fitness is to be obtained with respect to each set of ten kinds of classifications of works and eight kinds of features. Therefore, the arithmetic amount for obtaining the fitness is large. However, when the scattering work or compacting work is being carried out, the arithmetic work for obtaining the fitness is not carried out but a specific feature amount such as the complicatedness indicating amount of boom operation is merely compared with a predetermined value whereby the scattering work or compacting work can be discriminated with high accuracy, thus reducing the arithmetic load The discrimination of classifications of works as described above is carried out every time data of the data retaining section 40 is updated The second classification of work discriminating method in a further extended form will be described referring to a flowchart of FIG. 16.

In the classification of work discriminating section 41', first, all the operating amount average values of the boom, arm, bucket, swinging, right travel and left travel grasped by the grasping sections 50–55 are compared with a predetermined value Th1 determined in advance by the comparison section 59 (STEP 1). If the result of comparison is the operating amount average value≧Th1 with respect to all the operating amount average values, in other words, if all the operating amount average values are approximately "1", judgment is made in which the present content of work of the hydraulic excavator is a non-operating state in which all the work actuators 4–9 stop (the operation of the hydraulic excavator stops) (STEP 2).

This non-operating state is the state in which all the work actuators 4–9 stop. Therefore, in this state, all the operating levers 17 to 22 are not operated. Accordingly, in the case where the condition of STEP 1 is established, judgment can be made in which the hydraulic excavator is in the non-operating state.

If the condition of STEP 1 is not established, in the classification of work discriminating section 41', further, the operating amount average values of the boom, arm, bucket, and swinging grasped by the grasping sections 50–53 are compared with the aforementioned predetermined value Th1 by the comparison section 59, and the operating amount average values of the right travel and left travel are compared with a predetermined value Th2 (STEPS 3, 4). If the results of comparison are that the operating amount average value≦Th1 with respect to all the operating amount average values of the boom, arm, bucket and swinging and the operating amount average value≧Th2 with respect to at least one of the right travel and left travel, judgment is made in which the content of work of the hydraulic excavator is the travel operating state in which the travel operation of the hydraulic excavator by the hydraulic actuators 8 or 9 for travel is being made (STEP 5).

This travel operating state is the state in which a mere travel operation is being made while stopping the actuators 4–7 for work other than the actuators 8, 9 for travel. Therefore, in this state, out of the operating levers 17–22, only the right or left operating levers 19, 22 is operated. Accordingly, in the case where the conditions of STEPS 3, 4 are established, judgment is made to be the travel operating state.

In the case where any of the conditions of STEPS 3 and 4 is not established, the step goes to STEP 6. Operations after this are similar to that shown in FIG. 15.

On the basis of the classifications of works discriminated as described above, the setting sections 51–54 of the operating mode control section 42 and the auto acceleration control section 56 set the hydraulic pump absorbing horse power, the maximum discharge, the discharge rate of change, the response time constant and the auto acceleration control as shown in the following Table 1. The hydraulic pump control section 55 controls the discharge of the hydraulic pumps 2, 3 through the proportional solenoid valves 23, 24 in accordance with the set values of the hydraulic pump absorbing horse power and the like set every classification of work, and the auto acceleration control section 56 makes the auto acceleration control effective or invalid.

TABLE 1

| Classification of work | Hydraulic pump absorbing H.P.(%) | Maximum discharge (%) | Discharge rate of change* | Response time constant (sec) | Auto Acceleration control |
|---|---|---|---|---|---|
| Scattering | 80 | 80 | L | 0 | yes |
| Compacting | 80 | 80 | L | 0 | yes |
| Slope finish | 80 | 70 | M | 0.5 | yes |
| Crane | 70 | 70 | S | 0.5 | no |
| Digging w/swing | 100 | 100 | L | 0.2 | yes |
| Loading | 70 | 70 | S | 0.5 | no |
| Finish w/swing | 80 | 100 | M | 0.3 | yes |
| Simple, ditch, and horizontal digging | 100 | 100 | L | 0.2 | yes |

TABLE 1-continued

| Classification of work | Hydraulic pump absorbing H.P.(%) | Maximum discharge (%) | Discharge rate of change* | Response time constant (sec) | Auto Acceleration control |
|---|---|---|---|---|---|
| Discrimination disabled | 70 | 70 | S | 0.5 | no |

*L: large, M: medium, S: small

In this manner, the hydraulic excavator can be operated in the operating mode suitable for the classification of work.

That is, as shown in Table 1, in the digging work (including the digging with swing) which is the heavy load work as compared with other works, since the hydraulic pump absorbing horse power is set to 100% on the maximum, the work can be carried out using the output of the engine 1 to the maximum. Conversely, in the crane work and the loading work which is the light load work as compared with other works, since the hydraulic pump absorbing horse power is set to 70% on the minimum, the operation of the engine 1 with good fuel cost can be carried out. In other works, since the hydraulic pump absorbing horse power is set to 70% on the medium, the fuel cost of the engine 1 is relatively good while sufficiently drawing the output of the engine 1 to a degree as necessary.

In the digging work and the finishing with swing for which is required a high operating speed of the actuators 4–9 as compared with other works, since the maximum discharge is set to 100% on the maximum, it is possible to secure positively the operating speed necessary for the actuators 4–9. Conversely, in the slope finishing work, the crane work and the loading work for which is required a low operating speed of the actuators 4–9 as compared with other works, since the maximum discharge is set to 70% on the minimum, it is possible to avoid the situation in which when the operating levers 17–22 are carelessly operated greatly, the operating speed of the actuators 4–9 becomes high. In works other than those mentioned above, since the maximum discharge is set to 80% on the medium, it is possible to obtain the operating speed of the actuators 4–9 to a degree necessary for the works.

In the scattering work, the compacting work, and the digging work in which the change of the operating speed of the actuators 4–9 with respect to the change amount of the operating levers 17–22 is large as compared with that of the other works, since the discharge rate of change is set to the maximum discharge rate of change, these works can be carried out quickly. Conversely, in the crane work and the loading work for which the fine speed operation of the boom, arm and bucket is required as compared with other works, since the minimum discharge rate of change is set, the operating speed of the actuators 4–9 does not greatly change due to a slight change of the operating amount of the operating levers 17–22 but the work can be carried out at the desired operating speed. In works other than those mentioned above, since the discharge rate of change is set to the medium, the change of the operating speed of the actuators 4–9 with respect to the change amount of the operating amount of the operating levers 17–22 can be made suitable for these works.

In the scattering work and the compacting work for which the rapid responsibility of the operating speed of the actuators 4–9 with respect to the operating speed of the operating levers 17 to 22 is required as compared with the other works, since the response time constant is set to the minimum 0s, if the operating amount of the operating levers 17–22 is quickly increased or decreased, the operating speed of the actuator 4–9 immediately follow this and changes whereby the actuators 4–9 can be operated with good responsibility by the operation of the actuators 17–22. Conversely, in the crane work and the loading work in which the momentary movement of the actuators 4–9 possibly troubles the work, since the response time constant is set to the maximum 0.5s, even if the operating levers 17–22 are moved momentarily, the actuators 4–9 are not moved following this but the stable work can be carried out. In works other than those mentioned above, since the response time constant is set to the medium 0.3s or 0.2s, the responsibility and stability of the operation of the actuators 4–9 according to the operation of the operating levers 17–22 can be secured sufficiently to a degree as necessary.

Further, in the crane work and the loading work, all the operating levers 17–22 are often operated in the neutral position continuously for a certain period of time during the work. However, in these works, since the auto acceleration control is invalid, it is possible to avoid the situation that the engine speed is controlled to a low speed engine speed against the intention of an operator. In work other than those mentioned above, since the auto acceleration control is effective, if an operator returns all the operating levers 17–22 to their neutral position and stops the work, the engine speed is soon controlled to a low speed engine speed by the auto acceleration control section 56 whereby the fuel cost of the engine 1 can be improved. After this, if the operator operates the operating levers 17–22 in an attempt of re-starting the work, the engine speed is returned to its original engine speed, and the work can be carried out without trouble.

As described above, according to the hydraulic excavator of the present embodiment, various kinds of classifications of works can be automatically discriminated, whereby the switch operation by an operator is not required, and the hydraulic excavator can be operated in the operating mode suitable for the classifications of works.

In the controller 10, the work time of the content of work discriminated is integrated every predetermined time by the work time integrating section 43, as described above. The controller 10 records, in terms of time series, the results of discrimination (including disablement of discrimination) together with time data at the time of discrimination on the hard disk 61 every time the content of work is discriminated.

More specifically, the controller 10 records, in terms of time series, the results of discrimination (contents of work) together with the passage time from the reference date and time (for example, 0 o'clock 0 minute 0 second, Apr. 1, 1996) preset such as the date and time of manufacture of the hydraulic excavator as the time data, on the hard disk 61 in a format as shown in FIG. 19. In this case, the results of discrimination (content of work) including the case of disablement of discrimination are coded (for example, the non-operating state is "0" and the simple digging work is "1") and recorded on the hard disk 61.

The controller 10 records the integrated value of the work time every content of work (including disablement of discrimination) obtained by the work time integrating section 43 in a format shown in FIG. 20, for example, every time the content of work is discriminated. In this case, the integrated value of the work time recorded on the hard disk 61 is updated every time the content of work is discriminated. Numerals shown in the column of "content of work" in FIG. 20 refer to symbols of the content of work.

In this manner, data of the content of work recorded on the hard disk 61 are at any time read by connecting a personal computer or the like not shown to the hard disk 61 when the operation of the hydraulic excavator stops. In this case, the hydraulic excavator may be provided with a device in which when a predetermined switch operation is carried out, data of the hard disk 61 are displayed on a suitable display.

In the control apparatus for a hydraulic excavator according to the present embodiment, the content of work discriminated is readably recorded, in terms of time series, on the hard disk 61, and the integrated value of the work time every content of work disc discriminated is readably recorded on the hard disk 61.

Therefore, it is possible to grasp the time at which for example, an operator actually carried out the work and what kind of work was carried out. Thereby, it is possible to properly carry out the labor management such as the grasping of labor time of operators and decision of wages, etc.

Further, what work record the hydraulic excavator mounted on the hard disk 61 has is known from the data in terms of time series of the content of work recorded on the hard disk 61, and what work has done for how long period of time is known from the integrated value of work time every content of work. Therefore, it is possible to grasp a degree of deterioration of various apparatuses of the hydraulic excavator, whereby it is possible to carry out maintenance of the hydraulic excavator such as replacement of devices or the like at a proper time and with respect to proper devices. For example, if the frequency of the heavy load work such as the digging work is high in the time series data of the content of work, or if the integrated time of the heavy load work such as the digging work is long in the integrated value of work time every content of work, deterioration of working fluid of the hydraulic excavator or fluid of reduction gear is expected to occur early. Therefore, it is possible to carry out maintenance early to carry out proper maintenance and management of the hydraulic excavator.

Further, since the work record of the hydraulic excavator and the integrated value of the work time every content of work are known, it is possible, for example, to discriminate the hydraulic excavator which often carried out the heavy load work such as the digging work from the hydraulic excavator which often carried out the light load work such as the crane work to decide the price of assessment of used excavators and to properly evaluate the price of used excavators of the hydraulic excavator.

While in the present embodiment, many kinds of classifications of operations have been discriminated, it is of course that classifications of operations to be discriminated will suffice to be less than the former. For example, only one classification of operation may be discriminated and the hydraulic excavator may be operated in the operating mode corresponding thereto. In this case, only the sensor necessary for discriminating the classification of operation may be selectively provided.

Further, while in the present embodiment, the hydraulic pump absorbing horse power, the maximum discharge, the discharge rate of change, and the response time constant and the auto acceleration control have been set according to the cassifications of works, it is to be noted that all of them need not always be set depending on the classification of work, and other operating modes may be set.

Further, while in the present embodiment, the hydraulic pump absorbing horse power and the like have been fixedly set, it is to be noted that the hydraulic pump absorbing horse power may be maintained in the state already set in the case the discrimination is disabled.

Furthermore, while in the present embodiment, in the discrimination of classifications of operations, detected data of the travel operating amount sensors 27, 30 are not used, it is to be noted that the classification of operation may be discriminated using the detected data.

Moreover, while in the present embodiment, twelve kinds of contents of work have been discriminated, it is noted that for example, the content of work may be merely classified into the heavy load work and the light load work.

Further, while in the present embodiment, the hard disk 61 has been used as memory means, it is to be noted that other memory media such as a memory, floppy disk and the like may be used.

What is claimed is:

1. In a hydraulic excavator having hydraulic pumps, an engine, a plurality of operating levers for a boom, an arm, a bucket, a swing and a plurality of operating amount sensors for the boom, the arm, the bucket, and the swing, a control apparatus comprising:

an A/D converter for processing output signals from the operating amount sensors;

a section for retaining data indicative of the operating amount of levers for a predetermined period of time;

feature amount calculation means for obtaining at least one feature amount indicative of an operating state of said hydraulic excavator on the basis of said retaining data; and classification of work discriminating means for recognizing classifications of work being performed by the hydraulic excavator from said feature amount.

2. The hydraulic excavator control apparatus according to claim 1, wherein said classification of work discriminating means comprises:

a fitness calculation means for obtaining a fitness of each kind of feature amount with respect to each classification of work, on the basis of a plurality of membership functions for a fuzzy logic inference predetermined corresponding to every set of the classification of work and the kind of the feature amount obtained by said feature amount calculation means, so that the classification of work for which each feature amount is most fitted is recognized as the classification of work carried out by said hydraulic excavator on the basis of said fitness.

3. The hydraulic excavator control apparatus according to claim 1, further comprising: engine speed control means; pump discharge control means; and an operating mode control means for controlling at least one operation of said engine speed control means and said pump discharge control means, corresponding to said classification of work recognized by said classification of work discriminating means.

4. The hydraulic excavator control apparatus according to claim 1, further comprising memory means for readably storing and retaining the classification of work recognized by said classification of work discriminating means.

5. The hydraulic excavator control apparatus according to claim 1, wherein said feature amount calculation means comprises bucket operation complicatedness determination means, and said classification of work discriminating means comprises means for judging that a scattering work is carried out when a complicatedness indicating amount of bucket operation determined by said bucket operation complicatedness determination means exceeds a predetermined value.

6. The hydraulic excavator control apparatus according to claim 1, wherein said feature amount calculation means comprises boom operation complicatedness determination means, high speed swing time determination means, and bucket and arm stop time determination means, and said classification of work discriminating means comprises means for judging that a compacting work is carried out when a complicatedness indicating amount of boom operation determined by said boom operation complicatedness determination means is above a predetermined value, a high speed swing time determined by said high speed swing time determination means is less than a predetermined value and a bucket and arm stop time determined by said bucket and arm stop time determination means is above a predetermined value.

7. The hydraulic excavator control apparatus according to claim 1, wherein said feature amount calculation means comprises bucket operation complicatedness determination means, bucket and arm stop time determination means, boom reversing operation time determination means, arm operation average value determination means, and bucket operation average value determination means, and said classification of work discriminating means comprises means for judging that a slope finishing work is carried out when a complicatedness indicating amount of bucket operation determined by said bucket operation complicatedness determination means is less than a predetermined value, a bucket and arm stop time determined by said bucket and arm stop time determination means is less than a predetermined value, a boom reversing operation time determined by said boom reversing operation time determination means is above a predetermined value, and a total value of an arm operating amount average value and a bucket operating amount average value determined by said arm operation average value determination means and said bucket operation average value determination means, respectively, is above a predetermined value.

8. The hydraulic excavator control apparatus according to claim 1, wherein said feature amount calculation means comprises boom operation complicatedness determination means, bucket operation complicatedness determination means, bucket and arm stop time determination means, arm operation average value determination means, and bucket operation average value determination means, and said classification of work discriminating means comprises means for judging that a crane work is carried out when a complicatedness indicating amount of boom operation determined by said boom operation complicatedness determination means is less than a predetermined value, a complicatedness indicating amount of bucket operation determined by said bucket operation complicatedness determination means is less than a predetermined value, a high speed swing time determined by said high speed swing time determination means is less than a predetermined time, a bucket and arm stop time determined by said bucket and arm stop time determination means is less than a predetermined time, and a total value of an arm operating amount average value and a bucket operating amount average value determined by said arm operation average value determination means and said bucket operation average value determination means, respectively, is less than a predetermined value.

9. The hydraulic excavator control apparatus according to claim 1, wherein calculation means comprises high speed swing time determination means, bucket and arm stop time determination means, arm operation average value determination means, and bucket operation average value determination means, and said classification of work discriminating means comprises means for judging that a digging with the swing is carried out when a high speed swing time determined by said high speed swing time determination means is above a predetermined value, a bucket and arm stop time determined by said bucket and arm stop time determination means is less than a predetermined value, and a total value of an arm operating amount average value and a bucket operating amount average value determined by said arm operation value determination means and said bucket operation average value determination means, respectively, is above a predetermined value.

10. The hydraulic excavator control apparatus according to claim 1, wherein said feature amount calculation means comprises boom operation complicatedness determination means, bucket operation complicatedness determination means, high speed swing time determination means, and boom reversing operating time determination means, and said classification of work discriminating means comprises means for judging that a loading work is carried out when a complicatedness indicating amount of boom operation determined by said boom operation complicatedness determination means is less than a predetermined value, a complicatedness indicating amount of bucket operation determined by said bucket operation complicatedness determination means is less than a predetermined value, a high speed swing time determined by said high speed swing time determination means is less than a predetermined time, and a boom reversing operation time determined by said boom reversing operating time determination means is less than a predetermined time.

11. The hydraulic excavator control apparatus according to claim 1, wherein said feature amount calculation means comprises high speed swing time determination means, bucket and arm stop time determination means, boom operation average value determination means, and arm operation average value determination means, and said classification of work discriminating means comprises means for judging that finishing with a swing is carried out when a high speed swing time determined by said high speed swing time determination means is above a predetermined value, a bucket and arm stop time determined by said bucket and arm stop time determination means is above a predetermined value, and a total value of a boom operating amount average value and an arm operating amount average value determined by said boom operation average value determination means and said arm operation average value determination means, respectively, is less than a predetermined value.

12. The hydraulic excavator control apparatus according to claim 1, wherein said feature amount calculation means comprises boom operation average value determination means, and arm operation average value determination means, and said classification of work discriminating means comprises means for judging that a digging work other than said digging with the swing is carried out when a total value of a boom operating amount average value and an arm operating amount average value determined by said boom operation average value determination means and said arm operation average value determination means, respectively, is above a predetermined value.

13. The hydraulic excavator control apparatus according to claim 3, wherein said operating mode control means comprises means for setting at least one of a hydraulic pump absorbing horse power which is the rate for absorbing output of the engine by the hydraulic pump, a maximum discharge of working fluid from the hydraulic pump, a discharge rate of change of the working fluid, and a response time constant for work with respect to the operating amount of the operating levers.

14. The hydraulic excavator control apparatus according to claim 3, wherein said operating mode control means comprises auto acceleration means for controlling the engine to a predetermined low speed when the work stops in which the operating levers are at a neutral position, said auto acceleration means being controlled to an operating state or a nonoperating state according to the classification of work recognized by said classification of work discriminating means.

15. The hydraulic excavator control apparatus according to claim 3, wherein said classification of work discriminating means comprises means for classifying the classification of work into at least a digging work and works other than the former to discriminate them, and said operating mode control means comprises absorbing horse power setting means for setting a hydraulic pump absorbing horse power which is the rate for absorbing an output of the engine by the hydraulic pump according to the classification of work discriminated by said classification of work discriminating means, and hydraulic pump control means for controlling the hydraulic pump in accordance with the absorbing horse power set, said hydraulic pump absorbing horse power being set larger than that of the work other than the digging work when the discriminated classification of work is the digging work.

16. The hydraulic excavator control apparatus according to claim 15, wherein said absorbing horse power setting means sets said hydraulic pump absorbing horse power so that an output torque in each engine speed matches an output torque of the hydraulic pump when the discriminated classification of work is a digging work.

17. The hydraulic excavator control apparatus according to claim 3, wherein said classification of work discriminating means comprises means for classifying the classification of work into either crane work or loading work and works other than the former to discriminate them, said operating mode control means comprises absorbing horse power setting means for setting a hydraulic pump absorbing horse power which is the rate for absorbing an output of the engine by the hydraulic pump according to the classification of work discriminated by said classification of work discriminating means, and said pump discharge control means controls a pump discharge in accordance with said hydraulic pump absorbing horse power set by said absorbing horse power setting means, said hydraulic pump absorbing horse power being set smaller than that of the work other than either crane work or loading work when the discriminated classification of work is either crane work or loading work.

18. The hydraulic excavator control apparatus according to claim 3, wherein said classification of work discriminating means comprises means for classifying the classification of work into at least digging work and finishing with swing to discriminate them, said operating mode control means comprises maximum discharge setting means for setting a maximum discharge from said hydraulic pump according to the classification of work discriminated by said classification of work discriminating means, and said pump discharge control means controls a pump discharge to a level less than the set maximum discharge, said maximum discharge being set larger than that of work other than either digging work or finishing with swing when the discriminated classification of work is either digging work or finishing with swing.

19. The hydraulic excavator control apparatus according to claim 18, wherein said maximum discharge setting means sets, when the discriminated classification of work is a digging work and finishing with swing, said maximum discharge to a predetermined maximum discharge.

20. The hydraulic excavator control apparatus according to claim 3, wherein said classification of work discriminating means comprises means for classifying the classification of work into at least one of a crane work and a loading work and works other than the former to discriminate them, said operating mode control means comprises maximum discharge setting means for setting a maximum discharge from the hydraulic pump according to the classification of work discriminated by said classification of work discriminating means, and pump discharge control means controls a pump discharge to a level less than the set discharge, said maximum discharge being set smaller than that of works other than either crane work or loading work when the discriminated classification of work is either crane work or loading work.

21. The hydraulic excavator control apparatus according to claim 3, wherein said classification of work discriminating means comprises means for classifying the classification of work into at least one of a digging work, a compacting work and a scattering work and works other than the former to discriminate them, said operating mode control means comprises discharge rate of change setting means for setting a discharge rate of change with respect to an operating amount of the operating lever corresponding to the classification of work recognized by said classification of work discriminating means, and said pump discharge control means for controlling pump discharge in accordance with said discharge rate of change set by said discharge rate of change setting means, said discharge rate of change being set larger than that of works other than either digging work, compacting work or scattering work when the recognized classification of work is either digging work, compacting work or scattering work.

22. The hydraulic excavator control apparatus according to claim 3, wherein said classification of work discriminating means comprises means for classifying the classification of work into at least one of a crane work and a loading work to discriminate them, said operating mode control means comprises discharge rate of change setting means for setting a discharge rate of change with respect to an operating amount of the operating lever corresponding to the classification of work recognized by said classification of work discriminating means, and said pump discharge control means for controlling the pump discharge in accordance with said discharge rate of change set by said discharge rate of change setting means, said discharge rate of change being set smaller than that of works other than either crane work or loading work when the recognized classification of work is either crane work or loading work.

23. The hydraulic excavator control apparatus according to claim 3, wherein said classification of work discriminating means comprises means for classifying the classification of work into at least one of a compacting work and a scattering work to discriminate them, said operating mode control means comprises a response time constant setting means for setting a response time constant with respect to an operating amount of the operating lever corresponding to the classification of work recognized by said classification of work discriminating means, and said pump discharge control means for controlling pump discharge in accordance with said response time constant set by said response time constant setting means, said response time constant being set smaller than that of works other than either compacting work or scattering work when the recognized classification of work is either compacting work or scattering work.

24. The hydraulic excavator control apparatus according to claim 23, wherein said time constant setting means sets, when the classification of work is either compacting work or scattering work, said response time constant to zero.

25. The hydraulic excavator control apparatus according to claim 3, wherein said classification of work discriminating means comprises means for classifying the classification of work into at least one of a crane work, a loading work and a slope finishing work to discriminate them, said operating mode control means comprises a response time constant setting means for setting a response time constant with respect to the operating lever corresponding to the classification of work recognized by said classification of work discriminating means, and pump discharge control means for controlling pump discharge in accordance with said response time constant set by said response time constant setting means, said response time constant being set larger than that of works other than either crane work, loading work or slope finishing work when the recognized classification of work is either crane work, loading work or slope finishing work.

26. The hydraulic excavator control apparatus according to claim 3, wherein said engine speed control means comprises auto acceleration control means for controlling the engine to a predetermined low speed engine speed when work stops in which the operating lever for work is at a neutral position, said classification of work discriminating means comprises means for classifying the classification of work into at least one of a crane work and a loading work and work other than the former to discriminate them, and said operating mode control means controls said auto acceleration control means to a nonoperating state when the recognized classification of work is either crane work or loading work, and to an operating state when the classification of work recognized is work other than the crane work and the loading work.

27. The hydraulic excavator control apparatus according to claim 2, wherein said feature amount calculation means obtains, as the feature amount, at least one out of a boom operation complicatedness indicating amount indicative of the rate at which an operating amount of said operating lever for the boom increases or decreases within a predetermined time, a bucket operation complicatedness indicating amount indicative of the rate at which an operating amount of said operating lever for the bucket increases or decreases within a predetermined time, a high speed swing time indicative of the time at which the magnitude of an operating amount of said operating lever for swing exceeds a predetermined value within a predetermined time, a boom reversing operating time indicative of the time at which within a predetermined time, said operating amount of said operating lever for the boom exceeds a predetermined value on an up-side of the boom and said operating amount of said operating levers for the arm and the bucket exceeds a predetermined value on a pull-in side, a bucket and arm stop time indicative of the time at which within a predetermined time, the magnitude of said operating amount of said operating lever for the boom exceeds a predetermined value and the magnitude of said operating amount of said operating levers for the arm and the bucket is less than a predetermined value, a boom operating amount average value indicative of an average value of the magnitude of said operating amount of said operating levers for the boom, an arm operating amount average value and the bucket operating amount average value, said operating amount sensors detecting the operating amount of the operating lever corresponding to at least one feature amount.

28. The hydraulic excavator control apparatus according to claim 27, wherein said feature amount obtained by said feature amount calculation means includes said bucket operation complicatedness indicating amount, and when said bucket operation complicatedness indicating amount exceeds a predetermined value, the classification of work being done by the hydraulic excavator is recognized to be a scattering work not relying on the fitness obtained by said fitness calculation means.

29. The hydraulic excavator control apparatus according to claim 27, wherein said feature amount obtained by said feature amount calculation means includes said boom operation complicatedness indicating amount, said bucket and arm stop time and said high speed swing time, when said boom operation complicatedness indicating amount exceeds a predetermined value, said bucket and arm stop time exceeds a predetermined value and said high speed swing time is less than a predetermined time, the classification of work being done by the hydraulic excavator is recognized to be a compacting work not relying on the fitness obtained by said fitness calculation means.

30. The hydraulic excavator control apparatus according to claim 4, wherein said memory means stores and retains the content of work in terms of time series.

31. The hydraulic excavator control apparatus according to claim 4, further comprising operating time integrating means for integrating the operating time for every classification of work recognized by said classification work discriminating means, and memory means for readably storing and retaining the operating time for every classification of work obtained by said operating time integrating means.

* * * * *